US011691245B2

(12) United States Patent
Kyte et al.

(10) Patent No.: US 11,691,245 B2
(45) Date of Patent: Jul. 4, 2023

(54) SURFACE PREPARATION SUPPORT APPARATUS AND METHOD

(71) Applicant: The Boeing Company, Chicago, IL (US)

(72) Inventors: Kadon A. Kyte, Summerville, SC (US); Jason A. Kerestes, San Clemente, CA (US); Mary F. Tobin, Ridley Park, PA (US)

(73) Assignee: The Boeing Company, Arlington, VA (US)

( * ) Notice: Subject to any disclaimer, the term of this patent is extended or adjusted under 35 U.S.C. 154(b) by 645 days.

(21) Appl. No.: 16/794,519

(22) Filed: Feb. 19, 2020

(65) Prior Publication Data

US 2021/0252666 A1 Aug. 19, 2021

(51) Int. Cl.

| | |
|---|---|
| ***B24B 41/00*** | (2006.01) |
| ***B24B 41/02*** | (2006.01) |
| ***B24B 23/02*** | (2006.01) |

(52) U.S. Cl.

CPC ..... *B24B 41/02* (2013.01); *B24B 23/02* (2013.01)

(58) Field of Classification Search

CPC ..... B24B 7/182; B24B 23/02; B24B 41/02; B25H 5/00

See application file for complete search history.

(56) References Cited

U.S. PATENT DOCUMENTS

| | | | | |
|---|---|---|---|---|
| 5,138,800 | A * | 8/1992 | Janusz | B24C 3/065 451/92 |
| 5,540,172 | A * | 7/1996 | Goldbach | B63C 5/00 451/92 |
| 6,189,473 | B1 * | 2/2001 | Appel | B05B 13/005 114/222 |
| 7,074,111 | B2 | 7/2006 | Cecil et al. | |
| 9,364,935 | B2 | 6/2016 | Fuller | |
| 9,534,730 | B2 | 1/2017 | Black et al. | |
| 10,843,329 | B1 * | 11/2020 | Sterns | B25H 5/00 |
| 10,933,506 | B2 * | 3/2021 | Kerestes | B24B 23/026 |
| 10,948,125 | B2 * | 3/2021 | Kyte | F16M 11/18 |
| 2005/0064804 | A1 * | 3/2005 | Cecil | B24B 49/16 451/344 |
| 2017/0014991 | A1 * | 1/2017 | Fuentes | B23K 37/00 |
| 2017/0307132 | A1 * | 10/2017 | Kerestes | B66F 3/28 |
| 2019/0061141 | A1 * | 2/2019 | Whiteside | B25H 5/00 |

* cited by examiner

*Primary Examiner* — Eyamindae C Jallow
(74) *Attorney, Agent, or Firm* — Walters & Wasylyna LLC

(57) ABSTRACT

A surface preparation support apparatus includes a creeper and a linear actuator. The linear actuator includes a base-end and a tool-end that is opposite the base-end. The base-end is coupled to the creeper. The tool-end is linearly movable relative to the base-end. A surface preparation tool is coupleable to the tool-end of the linear actuator. The surface preparation support apparatus also includes an actuator-controller. The actuator-controller is coupled to the linear actuator. The actuator-controller is operable to selectively actuate the linear actuator. The surface preparation support apparatus further includes a tool-controller. The tool-controller is configured to be coupled to the surface preparation tool. The tool-controller is operable to selectively energize the surface preparation tool.

20 Claims, 12 Drawing Sheets

SURFACE PREPARATION SUPPORT APPARATUS AND METHOD

FIELD

The present disclosure relates generally to surface preparation and, more particularly, to surface preparation support apparatuses and methods of making and operating the same.

BACKGROUND

Various types of surface preparation tools are used to prepare a surface for a particular application. Examples of such surface preparation tools include sanders, grinders, and polishers. A known application of a surface preparation tool is preparing a low-profile surface, such as an underside or underbelly structure of an aircraft. Low-profile surface preparation can pose several ergonomic challenges for a person operating the surface preparation tool. For example, surface preparation operations can present the risk of repetitive motion injuries to the neck, shoulder, wrist, and/or lower back of an operator of the surface preparation tool. Accordingly, those skilled in the art continue with research and development efforts in the field of low-profile surface preparation and, as such, apparatuses and methods intended to address the above-identified concerns, would find utility

SUMMARY

The following is a non-exhaustive list of examples, which may or may not be claimed, of the subject matter according to the present disclosure.

In an example, a disclosed surface preparation support apparatus includes a creeper and a linear actuator. The linear actuator includes a base-end and a tool-end that is opposite the base-end. The base-end is coupled to the creeper. The tool-end is linearly movable relative to the base-end. A surface preparation tool is coupleable to the tool-end of the linear actuator. The surface preparation support apparatus also includes an actuator-controller. The actuator-controller is coupled to the linear actuator. The actuator-controller is operable to selectively actuate the linear actuator. The surface preparation support apparatus further includes a tool-controller. The tool-controller is configured to be coupled to the surface preparation tool. The tool-controller is operable to selectively energize the surface preparation tool.

In another example, the disclosed surface preparation support apparatus includes a creeper and a linear actuator. The linear actuator includes a base-end. The base-end is coupled to the creeper. The linear actuator also includes a tool-end. The tool-end is opposite the base-end. The tool-end is linearly movable relative to the base-end. The surface preparation support apparatus also includes a tool-mount. The tool-mount is coupled to the tool-end of the linear actuator. A surface preparation tool is coupleable to the tool-mount. The surface preparation support apparatus further includes an actuator-controller. The actuator-controller is coupled to the linear actuator. The actuator-controller is operable to selectively actuate the linear actuator. The surface preparation support apparatus additionally includes a tool-controller. The tool-controller is configured to be coupled to the surface preparation tool. The tool-controller is operable to selectively energize the surface preparation tool.

In an example, a disclosed method of making a surface preparation support apparatus includes steps of: (1) coupling a base-end of a linear actuator to a creeper; (2) coupling an actuator-controller to the linear actuator, in which the actuator-controller is operable to selectively actuate the linear actuator such that the tool-end of the linear actuator moves relative to the base-end of the linear actuator; (3) coupling a tool-mount to the tool-end of the linear actuator, in which the tool-mount is configured for attachment of a surface preparation tool; (4) configuring a tool-controller to be coupled to the surface preparation tool, in which the tool-controller is operable to selectively energize the surface preparation tool.

In an example, a disclosed method of preparing a low-profile surface includes steps of: (1) moving a creeper underneath the low-profile surface; (2) moving a surface preparation tool, coupled to a tool-end of a linear actuator, into operational contact with the low-profile surface by selectively actuating the linear actuator to move the tool-end of the linear actuator away from a base-end of the linear actuator that is coupled to the creeper; and (3) with the surface preparation tool in operational contact with the low-profile surface, selectively energizing the surface preparation tool.

Other examples of the disclosed apparatus and methods will become apparent from the following detailed description, the accompanying drawings, and the appended claims.

DETAILED DESCRIPTION

Figure 1:
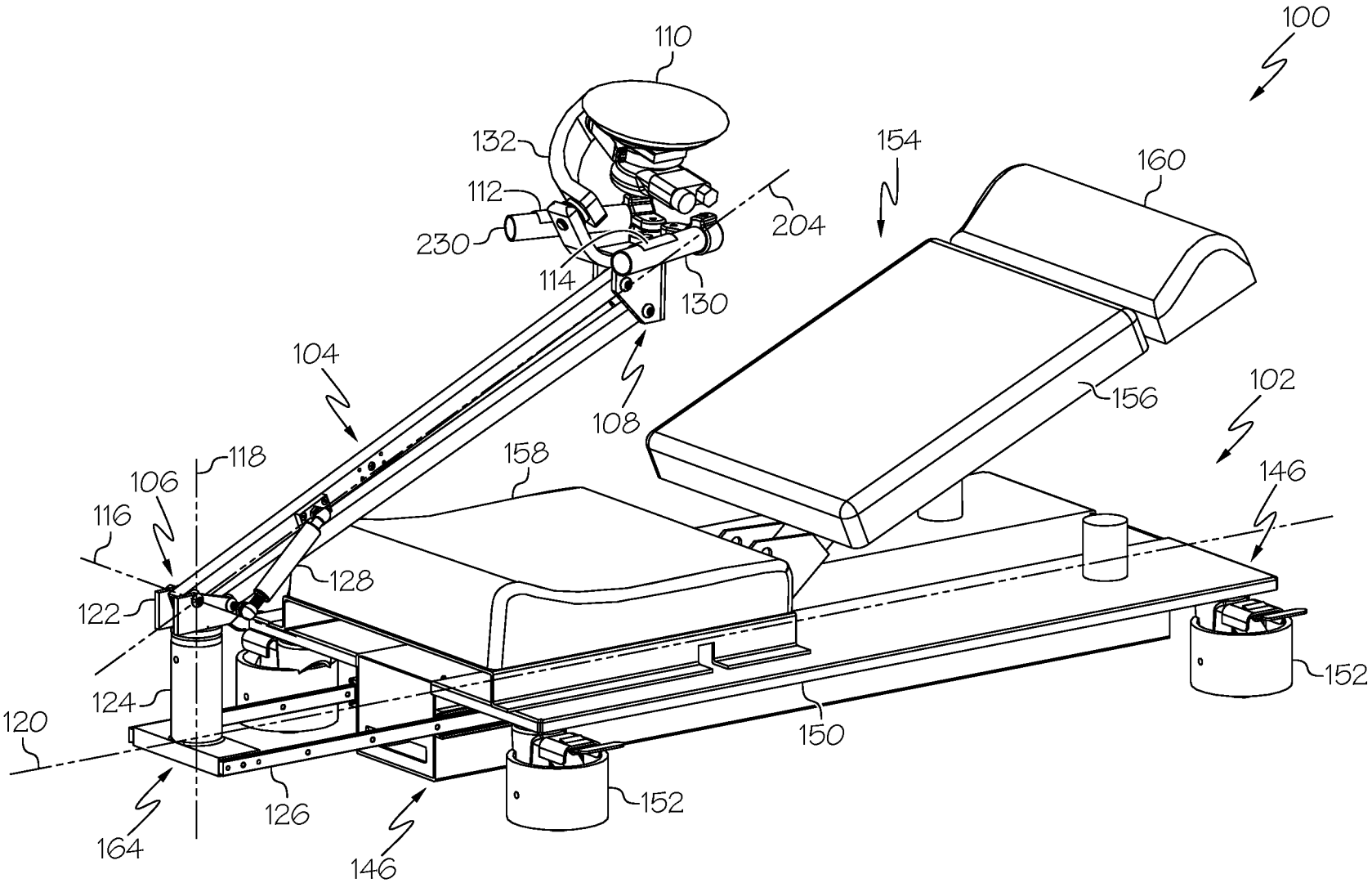
FIG. 1 is a schematic, perspective view of an example of a surface preparation support apparatus.

The following detailed description refers to the accompanying drawings, which illustrate specific examples described by the present disclosure. Other examples having different structures and operations do not depart from the scope of the present disclosure. Like reference numerals may refer to the same feature, element, or component in the different drawings.

Illustrative, non-exhaustive examples, which may be, but are not necessarily, claimed, of the subject matter according the present disclosure are provided below. Reference herein to "example" means that one or more feature, structure, element, component, characteristic, and/or operational step described in connection with the example is included in at least one aspect, embodiment, and/or implementation of the subject matter according to the present disclosure. Thus, the phrases "an example," "another example," "one or more examples," and similar language throughout the present disclosure may, but do not necessarily, refer to the same example. Further, the subject matter characterizing any one example may, but does not necessarily, include the subject matter characterizing any other example. Moreover, the subject matter characterizing any one example may be, but is not necessarily, combined with the subject matter characterizing any other example.

Referring generally to FIGS. 1-9, by way of examples, the present disclosure is directed to a surface preparation support apparatus 100, referred to generally herein as "apparatus." The disclosed apparatus 100 provides support and mobility for a surface preparation tool 110 that is capable of being controlled by a user (e.g., a technician, mechanic, or operator), while the user is in a supine position and is performing a surface preparation operation on a low-profile surface 200 (FIGS. 2 and 4) of a structure 202. The disclosed apparatus 100 mitigates safety and ergonomic challenges associated with surface preparation operations of low-profile surfaces.

For the purpose of the present disclosure, a "low-profile surface" refers to any worksurface of a structure that is located relatively close to the ground, such as that is located lower than is usual for objects of its type. For example, the low-profile surface 200 is a surface that is less than approximately 5 feet (1.5 meters) off the ground, such as less than approximately 3 feet (1 meter) off the ground. In one or more examples, the structure 202 is an aircraft and the low-profile surface 200 is an underside or underbelly surface of the aircraft.

Generally, the low-profile surface 200 is horizontal, such as approximately parallel to the ground, or is oriented at an acute angle relative to a horizontal plane, such as sloping toward or away from the ground. In some examples, one or more portions of the low-profile surface 200 is horizontal and one or more other portions of the low-profile surface 200 is oriented at an acute angle relative to the horizontal plane. In one or more examples, the low-profile surface 200 is substantially planar (e.g., has a substantially planar surface geometry). In one or more examples, the low-profile surface 200 is complex (e.g., has a complex surface geometry) or includes various contours (e.g., has a contoured surface geometry).

Throughout the present disclosure, the terms "horizontal" and "vertical" refer to a respective orientation relative to level ground. The terms horizontal and vertical include conditions in which the orientation is exactly horizontal or vertical and conditions in which the orientation if approximately horizontal or vertical.

Referring to FIGS. 1-4, the apparatus 100 includes a creeper 102 and a linear actuator 104. The linear actuator 104 is coupled to the creeper 102 and is movable relative to the creeper 102. The surface preparation tool 110 is coupled to the linear actuator 104. The linear actuator 104 is coupled to the creeper 102 via a movable joint 164. The movable joint 164 is configured to enable the linear actuator 104 to at least one of move (e.g., translate) along a linear-motion axis 120, rotate about a rotational-motion axis 118, and/or pivot about a pivotal-motion axis 116 relative to the creeper 102.

Generally, during a surface preparation operation, the apparatus 100 enables the surface preparation tool 110 to be placed into operational contact with the low-profile surface 200 upon which the surface preparation operation is to be performed. As used herein, the term "operational contact" refers to a condition in which the surface preparation tool 110 is in direct contact with the low-profile surface 200 under appropriate force such that the surface preparation operation (e.g., sanding, grinding, polishing, and the like) can be performed. With the surface preparation tool 110 in operational contact with the low-profile surface 200, the apparatus 100 enables movement of the surface preparation tool 110 relative to the low-profile surface 200.

Figure 2:
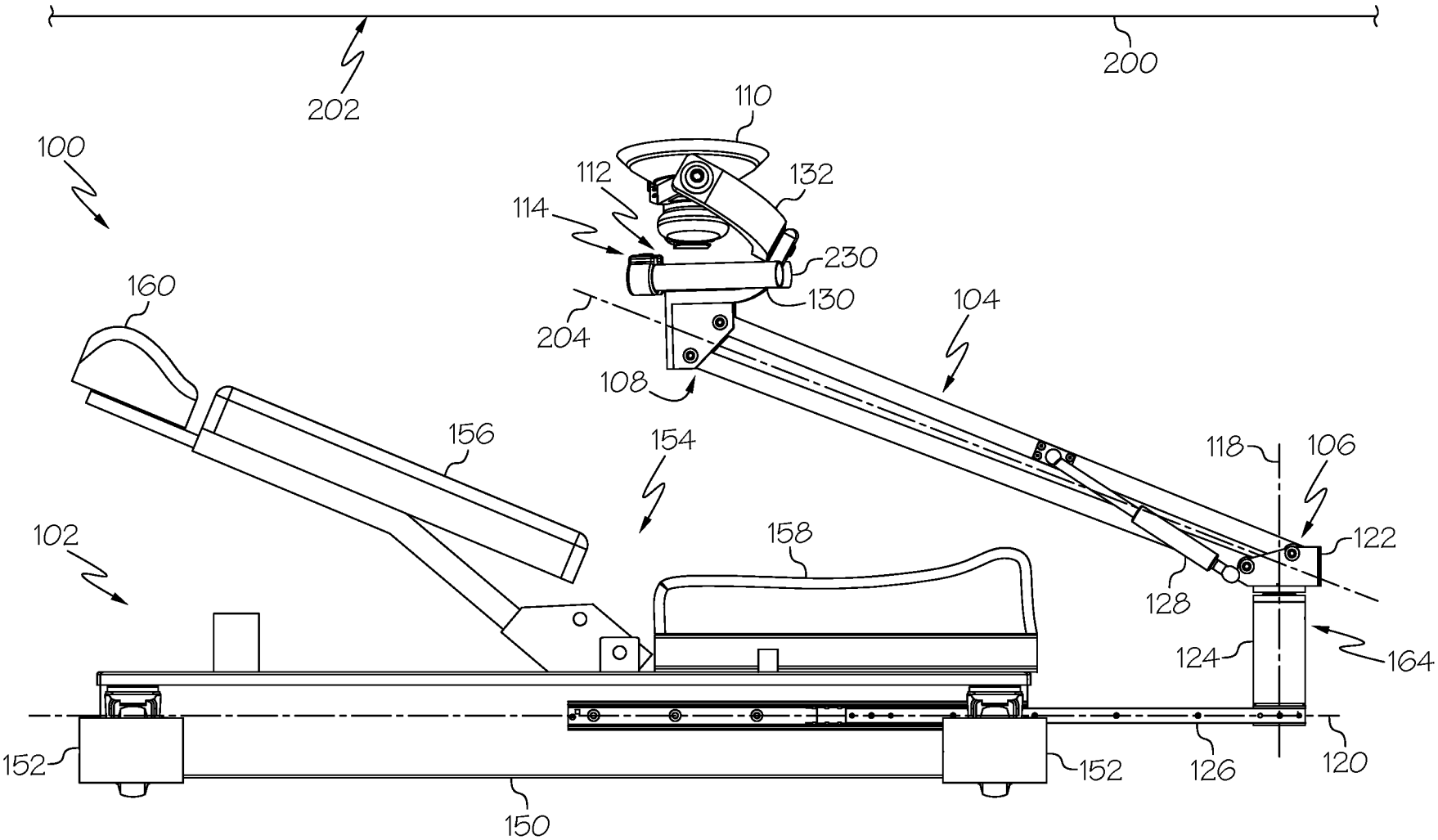
FIG. 2 is a schematic, side elevation view of an example of the surface preparation support apparatus, depicted underneath a low-profile surface.
Figure 4:
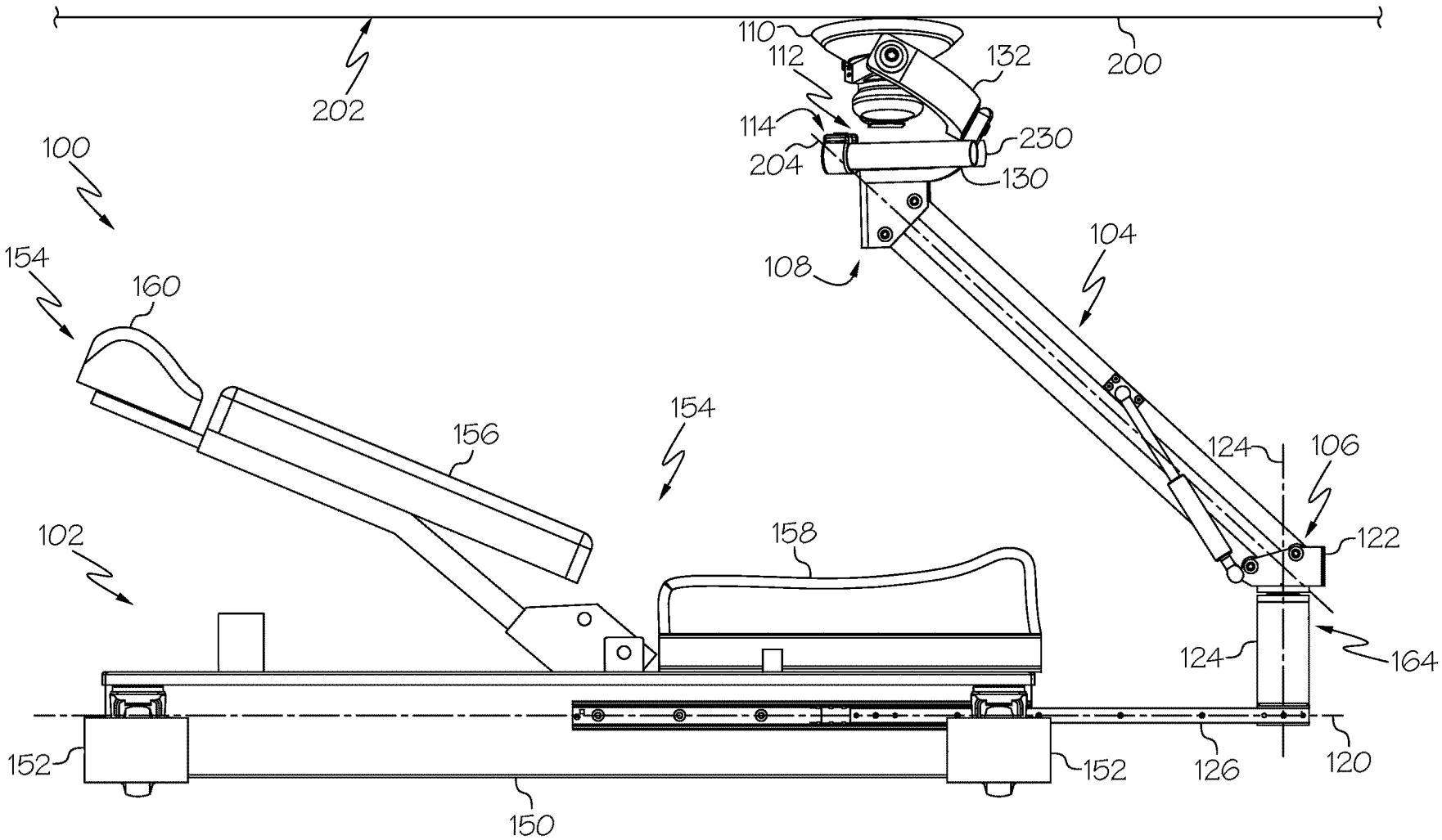
FIG. 4 is a schematic, side elevation view of an example of the surface preparation support apparatus, depicted underneath a low-profile surface with a surface preparation tool in contact with the low-profile surface.

As illustrated in FIGS. 2 and 4, with the apparatus 100 positioned underneath the low-profile surface 200, the apparatus 100 enables the surface preparation tool 110 to be translated along an axis relative to the low-profile surface 200 and enables the linear actuator 104 to be translated along an axis, rotated about an axis, and/or pivoted about an axis relative to the low-profile surface 200 under control of the user (not shown).

In one or more example implementations of the surface preparation operation, the user, operating the surface preparation tool 110, is supported by the creeper 102 in the supine position. The creeper 102 enables the user to move relative to the low-profile surface 200 of the structure 202 (FIGS. 2 and 4) and to position the surface preparation tool 110 relative to the low-profile surface 200, such as underneath the low-profile surface 200. The linear actuator 104 enables the surface preparation tool 110 to be selectively moved (e.g., raised and lowered) relative to the low-profile surface 200, such as moved into operational contact with the low-profile surface 200.

As such, the surface preparation tool 110 is moved into and out of operational contact with the low-profile surface 200 via extension of the linear actuator 104. Use of the linear actuator 104 to raise and lower the surface preparation tool 110 relative to the low-profile surface 200 reduces repeated motions of the user that are typically associated with manual surface preparation operations performed on a low-profile surface. In one or more examples, the surface preparation tool 110 is also held in operational contact with the low-profile surface 200 via of the linear actuator 104 (e.g., in an approximately extended state). Use of the linear actuator 104 to hold the surface preparation tool 110 in operational contact with the low-profile surface 200 reduces physical strain on the user that is typically associated with manual surface preparation operations performed on a low-profile surface.

With the surface preparation tool 110 in operational contact with the low-profile surface 200, the apparatus 100 enables the user to selectively energize the surface preparation tool 110 and initiate the surface preparation operation. With the surface preparation tool 110 in operational contact with the low-profile surface 200, the movable joint 164 enables the user to move the linear actuator 104 relative to the creeper 102, which, in turn, moves the surface preparation tool 110 relative to the low-profile surface 200, such as across the low-profile surface 200, during the surface preparation operation.

The creeper 102 includes any one of various types of low-profile, wheeled platforms that enables the user to lay in the supine position (e.g., facing generally upward) and maneuver under the structure 202 being worked on while remaining in the supine position.

In one or more examples, the creeper 102 includes a frame 150 and a plurality of wheel assemblies 152, coupled to the frame 150. The frame 150 is freely mobile on a support surface, such as the ground or work floor of a manufacturing environment, via the wheel assemblies 152. In one or more examples, the wheel assemblies 152 are located on opposing lateral sides and/or longitudinal ends of the frame 150. In one or more examples, at least one of the wheel assemblies 152 is configured to be selectively locked, in which the frame 150 is rendered immobile, or selectively unlocked, in which the frame 150 is rendered mobile. In one or more examples, each one of the wheel assemblies 152 includes a caster assembly.

In one or more examples, the creeper 102 includes a body pad 154. The body pad 154 is coupled to the frame 150. In one or more examples, the body pad 154 includes an upper body-pad section 156 and a lower body-pad section 158. The upper body-pad section 156 and the lower body-pad section 158 are coupled to the frame 150. Generally, the upper body-pad section 156 is designed to receive the upper body of the user from the waist up and the lower body-pad section 158 is designed to receive at least the upper portion of the legs of the user. In one or more examples, the body pad 154 includes a headrest 160 that is coupled to the upper body-pad section 156. The headrest 160 is designed to receive the head of the user.

In one or more examples, the upper body-pad section 156 is pivotable (e.g., configured to pivot or capable of being pivoted) relative to the lower body-pad section 158 and/or relative to the frame 150. For example, the upper body-pad section 156 is pivotally movable between and is configured to be selectively fixed at a horizontal position (e.g., approximately parallel to the frame 150) and at least one non-horizontal position (e.g., at a non-zero angle relative to the frame 150). In one or more examples, the upper body-pad section 156 and the lower body-pad section 158 are longitudinally spaced from each other to provide clearance so that the upper body-pad section 156 can be pivoted.

The linear actuator 104 is supported by the creeper 102, which renders mobile the linear actuator 104 on the support surface (e.g., the ground). The linear actuator 104 includes a translation axis 204. Generally, the translation axis 204 is a longitudinal axis or a central axis of the linear actuator 104. The linear actuator 104 includes a base-end 106 and a tool-end 108. The tool-end 108 is opposite the base-end 106 along the translation axis 204.

In one or more examples, the creeper 102 includes a head-end 146 and a foot-end 148 that is opposite the head-end 146. The linear actuator 104 is coupled to the foot-end 148 of the creeper 102. In one or more examples, the base-end 106 of the linear actuator 104 is coupled to the creeper 102. For example, the base-end 106 of the linear actuator 104 is coupled to the foot-end 148 of the creeper 102 via the movable joint 164.

The tool-end 108 of the linear actuator 104 is linearly movable relative to the base-end 106 of the linear actuator 104. For example, the tool-end 108 moves (e.g., translates) along the translation axis 204 relative to the base-end 106. In one or more examples, the linear actuator 104 is configured to be selectively positioned in a retracted state (e.g., retracted position), in which the tool-end 108 is moved toward the base-end 106, and an extended state (e.g., extended position), in which the tool-end 108 is moved away from the base-end 106.

For the purpose of the present disclosure, the terms "retracted state," "retracted position," "extended state," "extended position" and similar terms refer to the operating positions of the linear actuator 104, such as to the operating positions of the tool-end 108 relative to the base-end 106 or the operating positions of the surface preparation tool 110 relative to the low-profile surface 200. In one or more examples, the retracted state refers to a fully retracted position of the linear actuator 104 in which the tool-end 108 is fully retracted relative to the base-end 106. In one or more examples, the retracted state refers to a retracted position of the linear actuator 104 in which the surface preparation tool 110 is not in operational contact with the low-profile surface 200. In one or more examples, the extended state refers to any position other than the retracted position, such as a partially extended position or fully extended position of the linear actuator 104 in which the tool-end 108 is extended at least some distance relative to the base-end 106. In one or more examples, the extended state refers to an extended position of the linear actuator 104 in which the surface preparation tool 110 is in operational contact with the low-profile surface 200.

Figure 7:
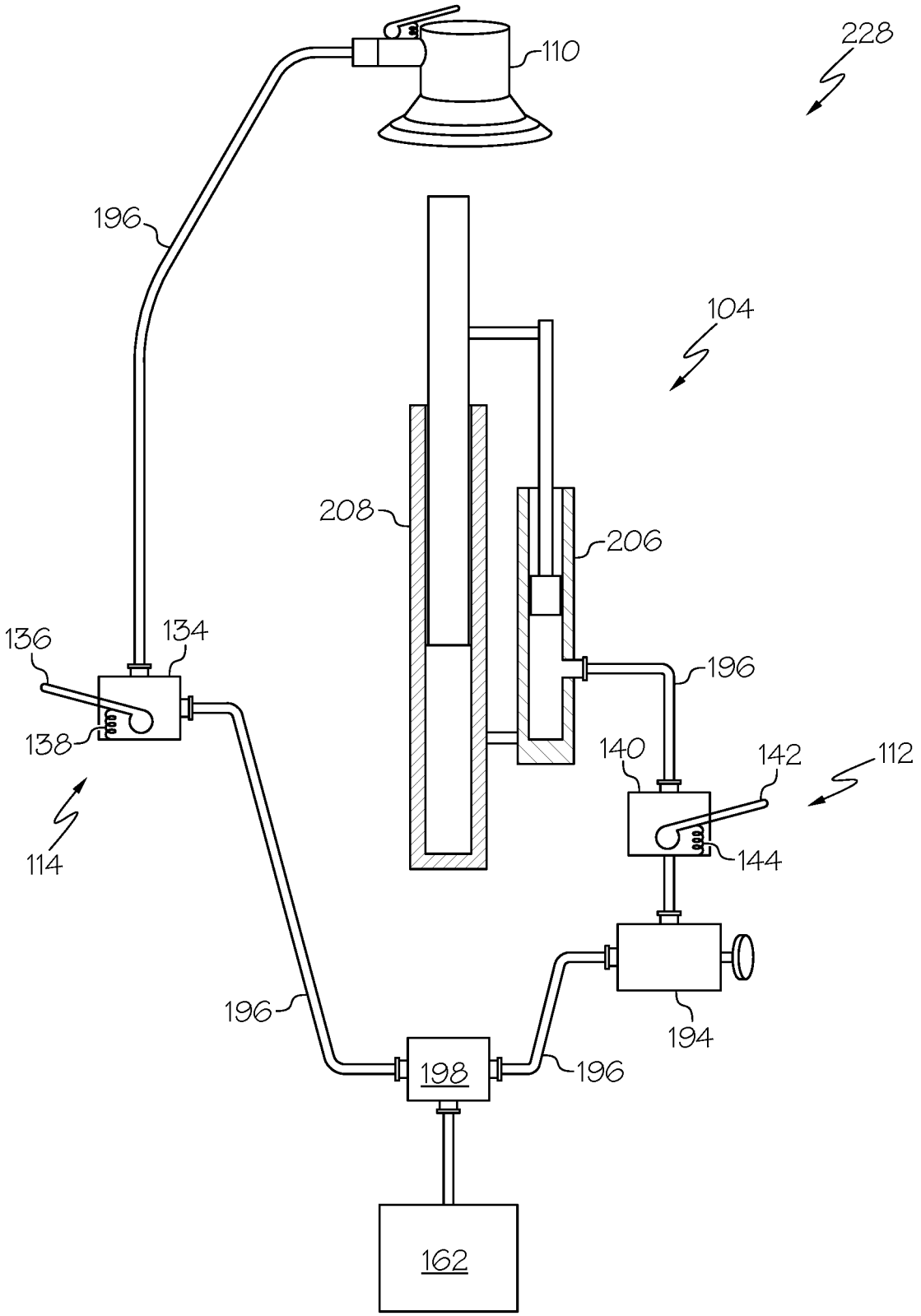
FIG. 7 is a schematic illustration of an example of a control system of the surface preparation support apparatus.

The linear actuator 104 includes, or is driven by, any one of various types of automatic actuators that creates motion in a straight line and is capable of being driven by any one of a variety of energy sources. In one or more examples, the linear actuator 104 includes, or is driven by, a pneumatic actuator that is powered by application of pressurized air from a source of compressed air, such as a compressed air source 162 (FIG. 7). In one or more examples, the linear actuator 104 includes, or is driven by, a mechanical or electro-mechanical actuator that is powered by application of electricity from a power supply. In one or more examples, the linear actuator 104 includes, or is driven by, a hydraulic actuator that is powered by application of pressurized liquid from a compressed liquid source. A pneumatically powered linear actuator 104 may be particularly advantageous in certain manufacturing environments where electrical or mechanical components are undesirable.

In various examples of the disclosed apparatus 100, the surface preparation tool 110 is coupleable (e.g., is configured to be coupled to or is capable of being coupled to) to the tool-end 108 of the linear actuator 104. With the surface preparation tool 110 coupled to the linear actuator 104, the surface preparation tool 110 is linearly moveable (e.g., raised and lowered) relative to the creeper 102 and relative to the low-profile surface 200 of the structure 202 (FIGS. 2 and 4) via the linear actuator 104. For example, with the creeper 102 located under the structure 202, the surface preparation tool 110 is moved in proximity to or into operational contact with the low-profile surface 200 via extending the linear actuator 104 and is moved away from or out of operational contact with the low-profile surface 200 via retracting the linear actuator 104. In one or more examples, the apparatus 100 includes the surface preparation tool 110.

The surface preparation tool 110 includes any one of various types of tools configured to perform one or more surface preparing or surface finishing operations. In one or more examples, the surface preparation tool 110 is a rotary surface preparation tool. As an example, the surface preparation tool 110 includes, or takes the form of, a rotary sander used to perform a sanding operation on the low-profile surface 200 (FIGS. 2 and 4). As another example, the surface preparation tool 110 includes, or takes the form of, a rotary polisher used to perform a polishing operation on the low-profile surface 200. As another example, the surface preparation tool 110 includes, or takes the form of, a rotary grinder used to perform a grinding operation on the low-profile surface.

The surface preparation tool 110 includes any one of various types of automatic (e.g., "power") tools and is capable of being powered by any one of a variety of energy sources. In one or more examples, the surface preparation tool 110 is a pneumatic power tool that is powered by application of pressurized air from a source of compressed air, such as the compressed air source 162 (FIG. 7). In one or more examples, the surface preparation tool 110 is an electric power tool that is powered by application of electricity from an electric power supply. A pneumatically powered surface preparation tool may be particularly advantageous in certain manufacturing environments where electrical or mechanical components are undesirable. Further, when both the surface preparation tool 110 and the linear actuator 104 are pneumatically powered, a shared, or common, source of compressed air (e.g., the compressed air source 162) may be used.

Figure 3:
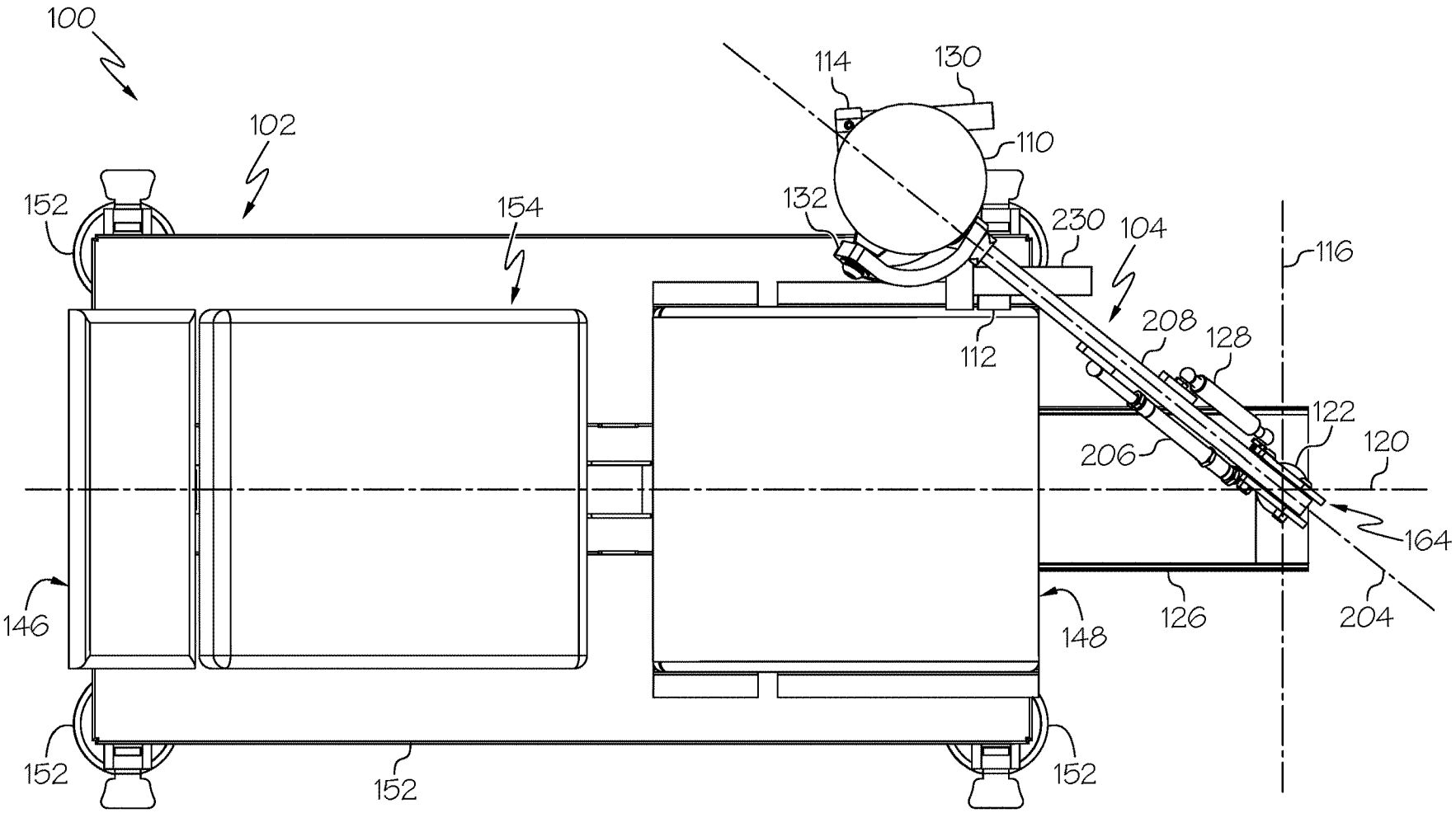
FIG. 3 is a schematic, top plan view of an example of the surface preparation support apparatus.

In one or more examples, the linear actuator 104 is pivotally movable relative to the creeper 102 about the pivotal-motion axis 116 (FIGS. 1 and 3). In one or more examples, the pivotal-motion axis 116 is horizontal.

In one or more examples, the apparatus 100 includes a pivotal coupling 122. The pivotal coupling 122 is an example of the movable joint 164 or forms a portion of the movable joint 164. The pivotal coupling 122 forms the pivotal-motion axis 116. In these examples, the linear actuator 104 is coupled to the creeper 102 and is pivotable about the pivotal-motion axis 116 relative to the creeper 102 via the pivotal coupling 122. In one or more examples, the pivotal coupling 122 is coupled to the creeper 102 and the base-end 106 of the linear actuator 104 is coupled to the pivotal coupling 122.

The pivotal coupling 122 includes, or takes the form of, any suitable mechanical device that is configured to join two components and enable one of the components to pivot about an axis relative to the other component. In one or more examples, the pivot coupling 122 includes, or takes the form of, a pivot joint, such as a clevis joint.

The pivotal coupling 122 enables the surface preparation tool 110 to move in a vertical direction (e.g., generally upward and downward motion) via pivoting the linear actuator 104 about the pivotal-motion axis 116 under control of the user. In other words, with the surface preparation tool 110 in operational contact with the low-profile surface 200, pivotal movement of the linear actuator 104 about the pivotal-motion axis 116 results in movement of the surface preparation tool 110 in the vertical direction without requiring further extension or retraction of the linear actuator 104.

In one or more examples, the geometry of the low-profile surface 200, the slope of the low-profile surface 200, and/or the contour of the low-profile surface 200 may vary in one or more directions. In other words, the vertical location of one or more portions of the low-profile surface 200 may be different than one or more other portions of the low-profile surface 200. As such, the vertical location of the surface preparation tool 110 may need to vary to accommodate variations in the geometry, slope, and/or contour of low-profile surface 200, to maintain the surface preparation tool 110 in operational contact with the low-profile surface 200 as the surface preparation tool 110 is moved across the low-profile surface 200, or to avoid obstructions on the low-profile surface 200. As previously expressed, with the surface preparation tool 110 in operational contact with the low-profile surface 200, the surface preparation tool 110 is moved across the low-profile surface 200 under control of the user.

In one or more examples, the vertical location of a portion of the low-profile surface 200 may decrease, such as due to a downward sloping portion or a convex portion of the low-profile surface 200. As the vertical location of a portion of the low-profile surface 200 decreases, a reaction force is applied to the surface preparation tool 110 by the low-profile surface 200, which pushes the surface preparation tool 110 downward and, thus, pivots the linear actuator 104 in a downward direction. In these examples, the surface preparation tool 110 is held in operational contact with the low-profile surface 200 via the linear actuator 104, without retraction of the linear actuator 104, and is moved across the low-profile surface 200 via the user.

In one or more examples, the vertical location of a portion of the low-profile surface 200 may increase, such as due to an upward sloping portion or a concave portion of the low-profile surface 200. As the vertical location of a portion of the low-profile surface 200 increases, a user force is applied to the linear actuator 104 by the user, which pivots the linear actuator 104 in an upward direction and, thus, pushes the surface preparation tool 110 upward. In these examples, the surface preparation tool 110 is held in operational contact with the low-profile surface 200 via the user, without further extension of the linear actuator 104, and is moved across the low-profile surface 200 via the user.

In one or more examples, the low-profile surface 200 may include one or more surface features (not illustrated). Such surface features may project (e.g., outwardly) from the low-profile surface 200 or may depend (e.g., inwardly) from low-profile surface 200. In these examples, such surface features may present an obstacle or obstruction in a path of the surface preparation tool 110 and, as such, it may be desirable to avoid such surface features. As the surface preparation tool 110 approaches the surface feature, a user force may be applied to the linear actuator 104 by the user, which pivots the linear actuator 104 in the downward direction and, thus, pulls the surface preparation tool 110 downward away from the low-profile surface 200. In these examples, the surface preparation tool 110 is temporarily removed from operational contact with the low-profile surface 200 via the user, without retraction of the linear actuator 104.

After avoiding the surface feature, the surface preparation tool 110 is repositioned back into operation contact with the low-profile surface 200. In one or more examples, a user force is applied to the linear actuator 104 by the user, which pivots the linear actuator 104 in the upward direction and, thus, pushes the surface preparation tool 110 upward into operation contact with the low-profile surface 200. Alternatively, as will be described in more detail here below, in one or more examples, a bias force is applied to the linear actuator 104, which pivots the linear actuator 104 in the upward direction and, thus, pushes the surface preparation tool 110 upward into operation contact with the low-profile surface 200.

Referring to FIGS. 1-6, in one or more examples, the apparatus 100 includes a biasing device 128. The biasing device 128 is configured to bias, or maintain, the linear actuator 104 at a (e.g., desired) biased angular orientation relative to a horizontal plane (e.g., that contains the pivotal-motion axis 116). In one or more examples, the biasing device 128 biases the linear actuator 104 at the biased angular orientation of between approximately 30-degrees and approximately 60-degrees above the horizontal plane. In one or more examples, the biasing device 128 biases the linear actuator 104 at the biased angular orientation of approximately 45-degrees above the horizontal plane.

In one or more examples, the biasing device 128 is coupled to (e.g., is coupled between) the linear actuator 104 and to the creeper 102. In one or more examples, the biasing device 128 is coupled to (e.g., is coupled between) the linear actuator 104 and to the movable joint 164. In one or more examples, the biasing device 128 is coupled to (e.g., is coupled between) the pivotal coupling 122 and to the linear actuator 104.

The biasing device 128 is configured to permit upward pivotable movement of the linear actuator 104 to an angular orientation greater than the biased angular orientation (e.g., greater than approximately 45 degrees) relative to the generally horizontal plane. For example, the biasing device 128 enables the linear actuator 104 to pivot away from the creeper 102 and toward the low-profile surface 200 in response to the user force pushing on the linear actuator 104 to raise the surface preparation tool 110 without further extension of the linear actuator 104. The biasing device 128 is configured to automatically return the linear actuator 104 to the biased angular orientation (e.g., upon removal of the user force).

The biasing device 128 is configured to permit downward pivotable movement of the linear actuator 104 to an angular orientation less than the biased angular orientation (e.g., less than approximately 45 degrees). For example, the biasing device 128 enables the linear actuator 104 to pivot toward from the creeper 102 and away the low-profile surface 200 in response to the user force pulling on the linear actuator 104 or the reaction force from the low-profile surface 200 pushing on the surface preparation tool 110 to lower the surface preparation tool 110 without retraction of the linear actuator 104. The biasing device 128 is configured to automatically return the linear actuator 104 to the biased angular orientation (e.g., upon removal of the user force or the reaction force).

The biasing device 128 may also serve as a stop that limits pivotal movement of the linear actuator 104 about the pivotal-motion axis 116 or otherwise set a limit for the angular orientation of the linear actuator 104 relative to the creeper 102.

In one or more examples, the biasing device 128 is configured to prevent the linear actuator 104 from approaching or falling below a lower-limit angular orientation relative to the horizontal plane during downward pivotal movement of the linear actuator 104 about the pivotal-motion axis 116 (e.g., toward the creeper 102). In one or more examples, the biasing device 128 prevents the linear actuator 104 from pivoting below the lower-limit angular orientation of approximately 30-degrees relative to the horizontal plane. Accordingly, the biasing device 128 prevents the linear actuator 104 and/or the surface preparation tool 110 from falling into contact with the user or the creeper 102 at any time the user force is not being applied to the linear actuator 104 (e.g., when the user is not actively engaging or holding the linear actuator 104).

In one or more examples, the biasing device 128 is configured to prevent the linear actuator 104 from approaching or raising above an upper-limit angular orientation relative to the generally horizontal plane (e.g., that contains the pivotal-motion axis 116) during upward pivotal movement of the linear actuator 104 about the pivotal-motion axis 116 (e.g., away from the creeper 102). In one or more examples, the biasing device 128 prevents the linear actuator 104 from pivoting above the upper-limit angular orientation of approximately 60-degrees relative to the horizontal plane. Accordingly, the biasing device 128 prevents the linear actuator 104 from reaching an over center orientation in which the linear actuator 104 and the surface preparation tool 110 could fall into the work floor.

The biasing device 128 includes, or takes the form of, any suitable device configured to provide the bias force that acts on the linear actuator 104 when the linear actuator 104 is pivoted, upwardly or downwardly, about the pivotal-motion axis 116 beyond the biased angular orientation relative to the horizontal plane. For example, the bias force acts in a direction that is opposite to downward pivotal movement of the linear actuator 104 and a direction that is opposite to upward pivotal movement of the linear actuator 104. In one or more examples, the biasing device 128 includes, or takes the form of, a mechanical device, a pneumatic device, or a hydraulic device. In one or more examples, the biasing device 128 is a spring.

In one or more examples, the biasing device 128 is also configured to dampen pivotal motion of the linear actuator 104, particularly during downward pivotal movement of the linear actuator 104 (e.g., in a direction toward the creeper 102). In one or more examples, the biasing device 128 includes, takes the form of, a mechanical dampener, pneumatic dampener, or hydraulic dampener (e.g., shock absorber).

Referring again to FIGS. 1-4, in one or more examples, the linear actuator 104 is rotationally movable relative to the creeper 102 about a rotational-motion axis 118 (FIGS. 1, 2 and 4). In one or more examples, the rotational-motion axis 118 is vertical.

In one or more examples, the apparatus 100 includes a rotational coupling 124. The rotational coupling 124 is an example of the movable joint 164 or forms a portion of the movable joint 164. The rotational coupling 124 forms the rotational-motion axis 118. In these examples, the linear actuator 104 is coupled to the creeper 102 and is rotatable about the rotational-motion axis 118 relative to creeper 102 via the rotational coupling 124. In one or more examples, the rotational coupling 124 is coupled to the creeper 102 and the base-end 106 of the linear actuator 104 is coupled to the rotational coupling 124.

The rotational coupling 124 includes, or takes the form of, any suitable mechanical device that is configured to join two components and enable one of the components to rotate about an axis relative to the other component. In one or more examples, the rotational coupling 124 includes, or takes the form of, rotary joint or rotary bearing.

The rotational coupling 124 enables the surface preparation tool 110 to move in a horizontal direction (e.g., generally side-to-side) via rotating the linear actuator 104 about the rotational-motion axis 118. In other words, with the surface preparation tool 110 in operational contact with the low-profile surface 200, rotational movement of the linear actuator 104 about the rotation-motion axis 118 results in movement of the surface preparation tool 110 in the horizontal direction (e.g., partial orbital movement about the rotational-motion axis 118).

In one or more examples, the linear actuator 104 is linearly movable relative to the creeper 102 along a linear-motion axis 120 (FIGS. 1-4). In one or more examples, the linear-motion axis 120 is horizontal.

In one or more examples, the apparatus 100 includes a linear coupling 126. The linear coupling 126 is an example of the movable joint 164 or forms a portion of the movable joint 164. The linear coupling 126 forms the linear-motion axis 120. In these examples, the linear actuator 104 is coupled to the creeper 102 and is linearly movable along the linear-motion axis 120 relative to the creeper 102 via the linear coupling 126. In one or more examples, the linear coupling 126 is coupled to the creeper 102 and the base-end 106 of the linear actuator 104 is coupled to the linear coupling 126.

The linear coupling 126 includes, or takes the form of, any suitable mechanical device that is configured to join two components and enable one of the components to linearly move (e.g., translate) along an axis relative to the other component. In one or more examples, the linear coupling 126 includes, or takes the form of, a prismatic joint, such as a slide rail or linear bearing slide.

The linear coupling 126 enables the surface preparation tool 110 to move in a horizontal direction (e.g., generally front-to-back) via linearly moving the linear actuator 104 along the linear-motion axis 120. In other words, with the surface preparation tool 110 in operational contact with the low-profile surface 200, linear movement of the linear actuator 104 along the linear-motion axis 120 results in movement of the surface preparation tool 110 in the horizontal direction.

In one or more examples, as illustrated in FIGS. 1-4, the movable joint 164 is configured to enable a combination of pivotal movement, rotational movement, and linear movement of the linear actuator 104 relative to the creeper 102. In one or more examples, the apparatus 100 includes at least two (e.g., a combination) of the pivotal coupling 122, the rotational coupling 124, and the linear coupling 126. In one or more examples, the apparatus 100 includes each one of the pivotal coupling 122, the rotational coupling 124, and the linear coupling 126.

In one or more examples, the linear coupling 126 is coupled to the creeper 102 and has (e.g., forms) the linear-motion axis 120. The linear actuator 104 is linearly movable along the linear-motion axis 120 relative to the creeper 102. The rotational coupling 124 is coupled to the linear coupling 126 and has (e.g., forms) the rotational-motion axis 118. The linear actuator 104 is rotationally movable about the rotational-motion axis 118 relative to the creeper 102 (e.g., relative to the linear coupling 126). The pivotal coupling 122 is coupled to the rotational coupling 124 and has (e.g., forms) the pivotal-motion axis 116. The linear actuator 104 is pivotally movable about the pivotal-motion axis 116 relative to the creeper 102 (e.g., relative to the rotational coupling 124).

In one or more examples, the rotational-motion axis 118 is approximately perpendicular to the linear-motion axis 120. In one or more examples, the pivotal-motion axis 116 is approximately perpendicular to the rotational-motion axis 118.

Figure 5:
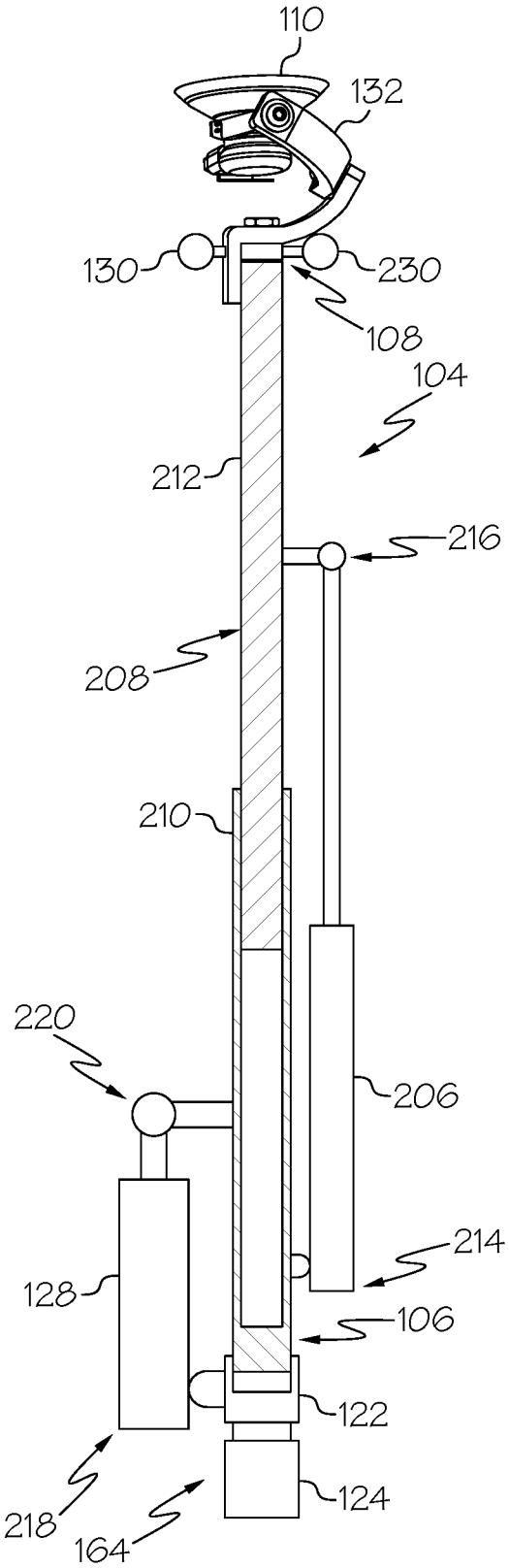
FIG. 5 is a schematic illustration of an example of a linear actuator of the surface preparation support apparatus.
Figure 6:
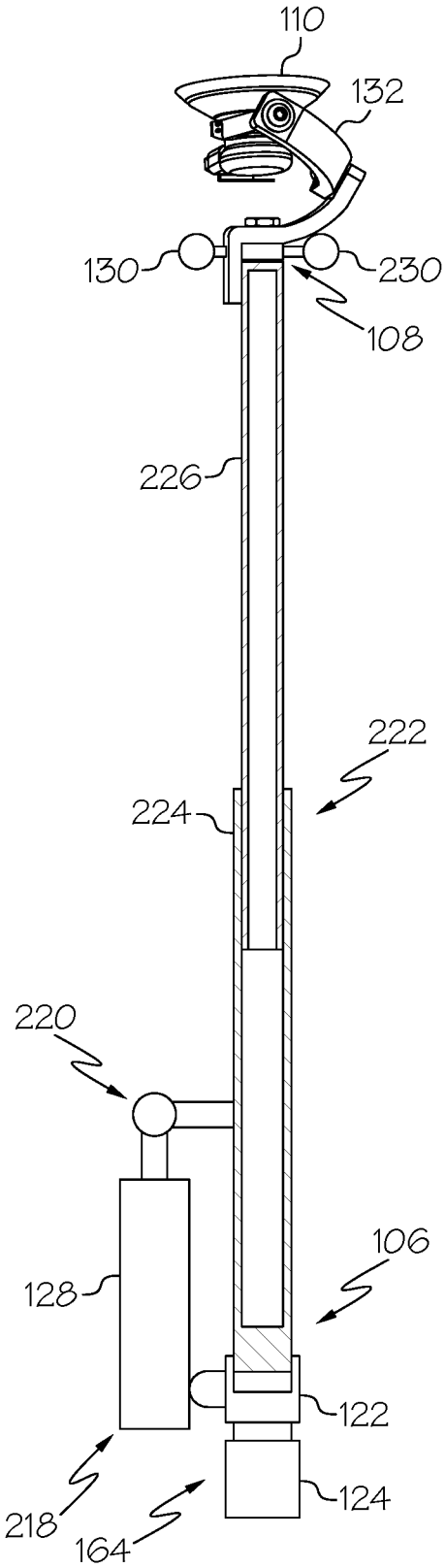
FIG. 6 is a schematic illustration of another example of the linear actuator of the surface preparation support apparatus.

Referring to FIGS. 5 and 6, the linear actuator 104 includes any one of various structural configurations that enable selective linear (e.g., translational) movement of the tool-end 108 along the translation axis 204 relative to the base-end 106.

As illustrated in FIG. 5, in one or more examples, the linear actuator 104 includes a telescoping arm 208. The telescoping arm 208 includes at least two arm-portions (e.g., a first arm-portion 210 and a second arm-portion 212) that are movable relative to each other to lengthen the telescoping arm 208. In these examples, the telescoping arm 208 includes, or forms, the base-end 106 and the tool-end 108 of the linear actuator 104. One end of the telescoping arm 208 (e.g., an end of the first arm-portion 210) is coupled to the movable joint 164, and the surface preparation tool 110 is coupled to an opposing end of the telescoping arm 208 (e.g., an end of the second arm-portion 212).

In these examples, the linear actuator 104 also includes a drive mechanism 206. The drive mechanism 206 is configured to drive movement of the tool-end 108 relative to the base-end 106 and, thus, extension and retraction of the telescoping arm 208 (e.g., extension and retraction of the linear actuator 104). In one or more examples, the drive mechanism 206 includes a drive-mechanism first end 214 that is coupled to the first arm-portion 210 and a drive-mechanism second end 216 that is coupled to the second arm-portion 212. The drive mechanism 206 is configured to selectively move the drive-mechanism second end 216 relative to the drive-mechanism first end 214, which in turn selectively moves the tool-end 108 relative to the base-end 106.

The drive mechanism 206 includes, or takes the form of, any one or various types of suitable actuators that creates motion in a straight line and is capable of being driven by any one of a variety of energy sources. In one or more examples, the drive mechanism 206 is a pneumatic actuator (e.g., a pneumatic cylinder) that is powered by application of pressurized air from a source of compressed air, such as the compressed air source 162 (FIG. 7). In one or more examples, the drive mechanism 206 is a mechanical or electro-mechanical actuator that is powered by application of electricity from a power supply. In one or more examples, the drive mechanism 206 is hydraulic actuator (e.g., a hydraulic cylinder) that is powered by application of pressurized liquid from a compressed liquid source.

In one or more examples, the biasing device 128 is coupled to (e.g., is coupled between) the telescoping arm 208 and the movable joint 164. For example, the biasing device 128 includes a biasing-device first end 218 that is coupled to the movable joint 164, such as to the pivotal coupling 122, and a biasing-device second end 220 that is coupled to the telescoping arm 208, such as to the first arm-portion 210.

The biasing-device first end 218 is coupled to the movable joint 164 such that the biasing device 128 can rotate about a rotational axis that passes though the biasing-device first end 218 and the movable joint 164. The biasing-device second end 220 is coupled to the telescoping arm 208 such that the biasing device 128 can rotate about a rotational axis that passes though the biasing-device second end 220 and the telescoping arm 208. The rotational connection between the biasing device 128 and the movable joint 164 and between the biasing device 128 and the telescoping arm 208 enables the linear actuator 104 to pivot about the pivotal-motion axis 116 relative to the creeper 102 (e.g., FIGS. 1 and 3).

As illustrated in FIG. 6, in one or more examples, the linear actuator 104 is formed by an actuator mechanism 222. In these examples, the actuator mechanism 222 includes at least two actuator-portions (e.g., a first actuator-portion 224 and a second actuator-portion 226) that are movable relative to each other to lengthen the actuator mechanism 222. In these examples, the actuator mechanism 222 includes, or forms, the base-end 106 and the tool-end 108 of the linear actuator 104. One end of the actuator mechanism 222 (e.g., an end of the first actuator-portion 224) is coupled to the movable joint 164 and the surface preparation tool 110 is coupled to an opposing end of the actuator mechanism 222 (e.g., an end of the second actuator-portion 226).

In these examples, the actuator mechanism 222 is configured to drive movement of the tool-end 108 relative to the base-end 106 (e.g., extension and retraction of the linear actuator 104)). The actuator mechanism 222 is configured to selectively move the second actuator-portion 226 relative to the first actuator-portion 224, which in turn selectively moves the tool-end 108 relative to the base-end 106.

The actuator mechanism 222 includes, or takes the form of, any one or various types of suitable actuators that creates motion in a straight line and is capable of being driven by any one of a variety of energy sources. In one or more examples, the actuator mechanism 222 is a pneumatic actuator (e.g., a pneumatic cylinder) that is powered by application of pressurized air from a source of compressed air, such as the compressed air source 162 (FIG. 7). In one or more examples, the actuator mechanism 222 is a mechanical or electro-mechanical actuator that is powered by application of electricity from a power supply. In one or more examples, the actuator mechanism 222 is hydraulic actuator (e.g., a hydraulic cylinder) that is powered by application of pressurized liquid from a compressed liquid source.

In one or more examples, the biasing device 128 is coupled to (e.g., is coupled between) the actuator mechanism 222 and the movable joint 164. For example, the biasing-device first end 218 is coupled to the movable joint 164, such as to the pivotal coupling 122, and the biasing-device second end 220 is coupled to the actuator mechanism 222, such as to the first actuator-portion 224.

The biasing-device first end 218 is coupled to the movable joint 164 such that the biasing device 128 can rotate about a rotational axis that passes though the biasing-device first end 218 and the movable joint 164. The biasing-device second end 220 is coupled to the actuator mechanism 222 such that the biasing device 128 can rotate about a rotational axis that passes though the biasing-device second end 220 and the actuator mechanism 222. The rotational connection between the biasing device 128 and the movable joint 164 and between the biasing device 128 and the actuator mechanism 222 enables the linear actuator 104 to pivot about the pivotal-motion axis 116 relative to the creeper 102 (e.g., FIGS. 1 and 3).

Referring to FIGS. 1-4, 7 and 10, in one or more examples, the apparatus 100 includes an actuator-controller 112. The actuator-controller 112 is coupled to the linear actuator 104. The actuator-controller 112 is operable (e.g., is configured) to selectively actuate the linear actuator 104. In one or more examples, the apparatus 100 includes a tool-controller 114. The tool-controller 114 is configured to be coupled (e.g., is coupleable) to the surface preparation tool 110. The tool-controller 114 is operable (e.g., is configured) to selectively energize the surface preparation tool 110.

In one or more examples, the surface preparation tool 110 is a pneumatic-powered tool. In one or more examples, the linear actuator 104 (e.g., the drive mechanism 206 (FIG. 5) or the actuator mechanism 222 (FIG. 6)) is a pneumatic actuator. In these examples, the tool-controller 114 is a pneumatic tool-controller and the actuator-controller 112 is a pneumatic actuator-controller.

FIG. 7 schematically illustrates an example of a control system 228 for the apparatus 100 that is configured to control the supply, or flow, of pressurized air to the surface preparation tool 110 and the linear actuator 104. FIG. 7 illustrates application of the control system 228 to examples of the linear actuator 104 that include the telescoping arm 208 and the drive mechanism 206 (FIG. 5). However, the control system 228 is equally applicable to examples of the linear actuator 104 that include the actuator mechanism 222 (FIG. 6).

In one or more examples, the tool-controller 114 includes a pneumatic tool-valve 134. The pneumatic tool-valve 134 is coupled to the surface preparation tool 110. The pneumatic tool-valve 134 is selectively opened or closed such that the compressed air source 162 is in selective fluid communication with the surface preparation tool 110. For example, the pneumatic tool-valve 134 is configured to be selectively actuated between an open position to supply a flow of pressurized air to the surface preparation tool 110 and a closed position to restrict the flow of pressurized air to the surface preparation tool 110. In one or more examples, the tool-controller 114 includes a tool-valve control 136. The tool-valve control 136 is coupled to the pneumatic tool-valve 134. The tool-valve control 136 is operable (e.g., configured) to selectively actuate the pneumatic tool-valve 134 between the open position and the closed position.

In one or more examples, the pneumatic tool-valve 134 is a two-way, two-position, normally closed directional valve. In one or more examples, the tool-valve control 136 includes any suitable mechanical or electrical coupling or linkage that is operable to selectively actuate the pneumatic tool-valve 134. In one or more examples, physical engagement or movement of the tool-valve control 136 selectively actuates the pneumatic tool-valve 134, such as by being manually depressed by the user using one hand. Examples of the tool-valve control 136 include, but are not limited to, a lever arm, a switch, a trigger, and the like.

In one or more examples, the tool-controller 114 includes a tool-biasing mechanism 138. The tool-biasing mechanism 138 is configured to bias the pneumatic tool-valve 134 in the closed position. In one or more examples, the tool-valve control 136 is moveable between an "on" position that selectively actuates the pneumatic tool-valve 134 in the open position and an "off" position that selectively actuates the pneumatic tool-valve 134 in the closed position. The tool-biasing mechanism 138 is operable to bias the tool-valve control 136 in the "off" position such that the pneumatic tool-valve 134 is closed. In one or more examples, the tool-biasing mechanism 138 is coupled to the tool-valve control 136 to bias the tool-valve control 136 in the "off" position. In one or more examples, the tool-biasing mechanism 138 is a spring.

In one or more examples, when the tool-valve control 136 is not being actively engaged (e.g., depressed) by the user, the tool-biasing mechanism 138 urges the tool-valve control 136 in the "off" position and, thus, the pneumatic tool-valve 134 in the closed position, thereby automatically de-energizing the surface preparation tool 110. In these examples, the tool-controller 114 acts as a deadman valve or a deadman switch such that the surface preparation tool 110 is automatically de-energized at any point where an actuation force is not being applied to the tool-valve control 136.

In one or more examples, the pneumatic tool-valve 134 is configured to selectively adjust a flow rate of pressurized air to the surface preparation tool 110. For example, the flow rate of pressurized air is proportionally adjusted in response to the amount of movement or the magnitude of the actuation force applied to the tool-valve control 136 and, thus, to the proportionally adjusted open position of the pneumatic tool-valve 134. Selective adjustment of the flow rate of pressurized air to the surface preparation tool 110 enables selective control over the operating speed and/or power of the surface preparation tool 110.

Other examples and configurations of the tool-controller 114 are also contemplated depending, for example, on the type of surface preparation tool 110 being used and the type of manufacturing environment in which the surface preparation operation is being performed. As an example, the pneumatic tool-valve 134 is a solenoid valve with an automatic return and the tool-valve control 136 is an actuation switch. As another example, such as where the surface preparation tool 110 is an electrically powered tool, the tool-controller 114 includes, or takes the form of, an electrical switch.

In one or more examples, the actuator-controller 112 includes a pneumatic actuator-valve 140. The pneumatic actuator-valve 140 is coupled to the linear actuator 104, such as to the drive mechanism 206 (FIG. 5) or to the actuator mechanism 222 (FIG. 6). The pneumatic actuator-valve 140 is selectively opened or closed. such that the compressed air source 162 is in selective fluid communication with the linear actuator 104. For example, the pneumatic actuator-valve 140 is configured to be selectively actuated between an open position to supply a flow of pressurized air to the linear actuator 104 and a closed position to restrict the flow of pressurized air to the linear actuator 104. In one or more examples, the actuator-controller 112 includes an actuator-valve control 142. The actuator-valve control 142 is coupled to the pneumatic actuator-valve 140. The actuator-valve control 142 is configured to selectively actuate the pneumatic actuator-valve 140 between the open position and the closed position.

In one or more examples, the pneumatic actuator-valve 140 is a two-way, two-position, normally closed directional valve. In one or more examples, the actuator-valve control 142 includes any suitable mechanical or electrical coupling or linkage that is operable to selectively actuate the pneumatic actuator-valve 140. In one or more examples, physical engagement or movement of the actuator-valve control 142 selectively actuates the pneumatic actuator-valve 140, such as by being manually depressed by the user using one hand. Examples of the actuator-valve control 142 include, but are not limited to, a lever arm, a switch, a trigger, and the like.

In one or more examples, the actuator-controller 112 includes an actuator-biasing mechanism 144. The actuator-biasing mechanism 144 is configured to bias the pneumatic actuator-valve 140 in the closed position. In one or more examples, the actuator-valve control 142 is moveable between an "on" position that actuates the pneumatic actuator-valve 140 in the open position and an "off" position that selectively actuates the pneumatic actuator-valve 140 in the closed position. The actuator-biasing mechanism 144 is operable to bias the actuator-valve control 142 in the "off" position such that the pneumatic actuator-valve 140 is closed. In one or more examples, the actuator-biasing mechanism 144 is coupled to the actuator-valve control 142 to bias the actuator-valve control 142 in the "off" position. In one or more examples, the actuator-biasing mechanism 144 is a spring.

In one or more examples, when the actuator-valve control 142 is not being actively engaged (e.g., depressed) by the user, the actuator-biasing mechanism 144 urges the actuator-valve control 142 in the "off" position and, thus, the pneumatic actuator-valve 140 in the closed position, thereby automatically restricting the flow of pressurized air to (e.g., de-activating) the linear actuator 104. In these examples, the actuator-controller 112 acts as a deadman valve or a deadman switch such that the flow of pressurized air to the linear actuator 104 is automatically restricted (e.g., the linear actuator 104 is automatically de-activated) at any point where an actuation force is not being applied to the actuator-valve control 142.

In one or more examples, the pneumatic actuator-valve 140 is configured to selectively adjust a flow rate of pressurized air to the linear actuator 104. For example, the flow rate of pressurized air is proportionally adjusted in response to the amount of movement or the magnitude of the actuation force applied to the actuator-valve control 142 and, thus, to the proportionally adjusted open position of the pneumatic actuator-valve 140. Selective adjustment of the flow rate of pressurized air to the linear actuator 104 enables selective control over the operating speed and/or force of the linear actuator 104.

Other examples and configurations of the actuator-controller 112 are also contemplated depending, for example, on the type of linear actuator 104 being used and the type of manufacturing environment in which the surface preparation operation is being performed. As an example, the pneumatic actuator-valve 140 is a solenoid valve with an automatic return and the actuator-valve control 142 is an actuation switch. As another example, such as where the linear actuator 104 is an electro-mechanical actuator, the actuator-controller 112 includes, or takes the form of, an electrical switch.

In one or more examples, when in the closed position, the pneumatic actuator-valve 140 is configured to exhaust pressurized air from the linear actuator 104. Exhausting pressurized air from the linear actuator 104 when the pneumatic actuator-valve 140 is selectively closed passively moves the linear actuator 104 to the retracted state. In other words, with the pneumatic actuator-valve 140 closed, the pneumatic actuator-valve 140 automatically exhausts pressurized air from the linear actuator 104 such that the linear actuator 104 passively moves from the extended state to the retracted state. For example, the linear actuator 104 includes, or is driven by, a single-acting linear actuator and the pneumatic actuator-valve 140 is a three-way, two-position, normally closed directional valve. In such an example, passive retraction of the linear actuator 104 is accomplished by the force of gravity and/or by a biasing member (e.g., an integral spring) of the linear actuator 104 acting on the tool-end 108 relative to the base-end 106.

In one or more examples, with the pneumatic actuator-valve 140 closed, the pneumatic actuator-valve 140 is configured to supply a flow of pressurized air to the linear actuator 104 such that the linear actuator 104 actively moves from the extended state to the retracted state. For example, the linear actuator 104 includes, or is driven by, a double-acting linear actuator and the pneumatic actuator-valve 140 is a four-way, two-position, normally closed directional valve. In such an example, active retraction of the linear actuator 104 is accomplished by the force of pressurized air supplied to the linear actuator 104.

In one or more example, the apparatus 100 include a pressure regulator 194. The pressure regulator 194 is configured to maintain pressurized air supplied to the linear actuator 104 at a substantially constant selected (e.g., desired) pressure. The selected pressure is controlled by or is pre-set by the user and may depend on various factors, such as the type of surface being worked on, the type of surface preparation operation being performed, the type of surface preparation tool 110 being used, and the like.

With the surface preparation tool 110 in operational contact with the low-profile surface 200, the pressure regulator 194 maintains a substantially constant pressure applied to the linear actuator 104 such that a contact force applied by the surface preparation tool 110 against the low-profile surface 200 is substantially constant as the surface preparation tool 110 is moved across the low-profile surface 200 under control of the user, such as by rotationally moving the linear actuator 104 about the rotational-motion axis 118 and/or linearly moving the linear actuator 104 along the linear-motion axis 120 (e.g., FIGS. 1-4).

In one or more examples, the pressure regulator 194 regulates pressure in an air chamber of a pneumatic cylinder of the drive mechanism 206 of the linear actuator 104 (e.g., FIG. 5) by equalizing pressure in the pneumatic cylinder when the surface preparation tool 110 is in operational contact with the low-profile surface 200. In one or more examples, the pressure regulator 194 regulates pressure in an air chamber of a pneumatic cylinder of the actuator mechanism 222 of the linear actuator 104 (e.g., FIG. 6) by equalizing pressure in the pneumatic cylinder when the surface preparation tool 110 is in operational contact with the low-profile surface 200. Any one of various suitable types of pressure regulators may be used for the pressure regulator 194.

Accordingly, use of the linear actuator 104 and the pressure regulator 194 enables the surface preparation tool 110 to be maintained in operational contact with the low-profile surface 200 while applying a substantially constant force. This configuration does not require the user to actively apply an upward user force to the linear actuator 104 (e.g., to upwardly pivot the linear actuator) or actively hold the surface preparation tool 110 in operational contact with the low-profile surface 200.

In one or more examples, the compressed air source 162 provides pressurized air via pneumatic lines 196 to an air inlet of the pneumatic tool-valve 134 of the tool-controller 114 and to the pneumatic actuator-valve 140 of the actuator-controller 112. The flow of pressurized air that passes through the pneumatic tool-valve 134 along the pneumatic lines 196 to the surface preparation tool 110 is controlled by the tool-valve control 136, such as operated by the user. The flow of pressurized air that passes through the pneumatic actuator-valve 140 along the pneumatic lines 196 to the linear actuator 104 is controlled by the actuator-valve control 142, such as operated by the user.

In one or more examples, the apparatus 100 includes a manifold 198. The manifold 198 is configured to direct the flow of pressurized air along the pneumatic lines 196 to the linear actuator 104 via the pneumatic actuator-valve 140 and to the surface preparation tool 110 via the pneumatic tool-valve 134.

Figure 8:
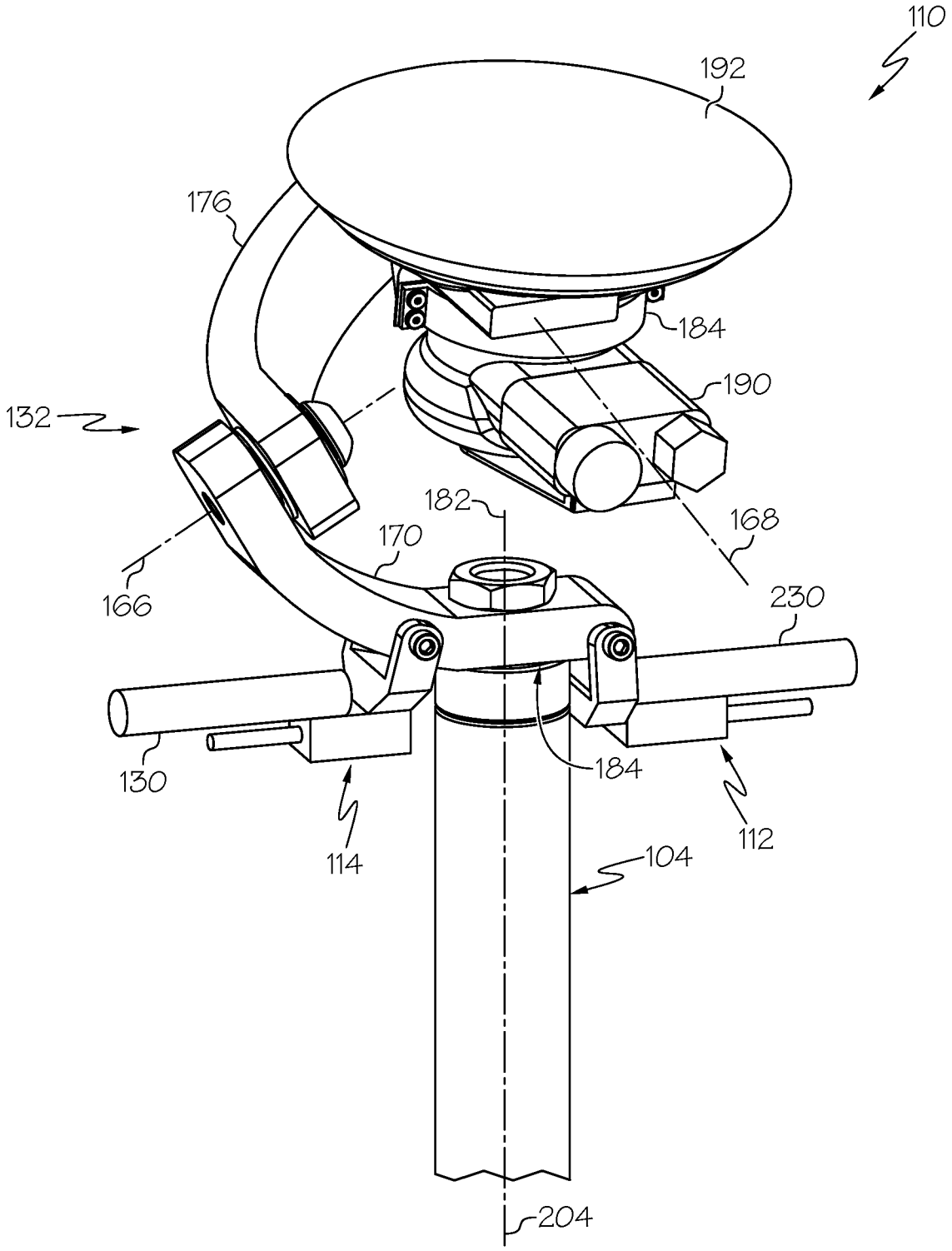
FIG. 8 is a schematic, perspective view of an example of a surface preparation tool coupled to the linear actuator of the surface preparation support apparatus.
Figure 9:
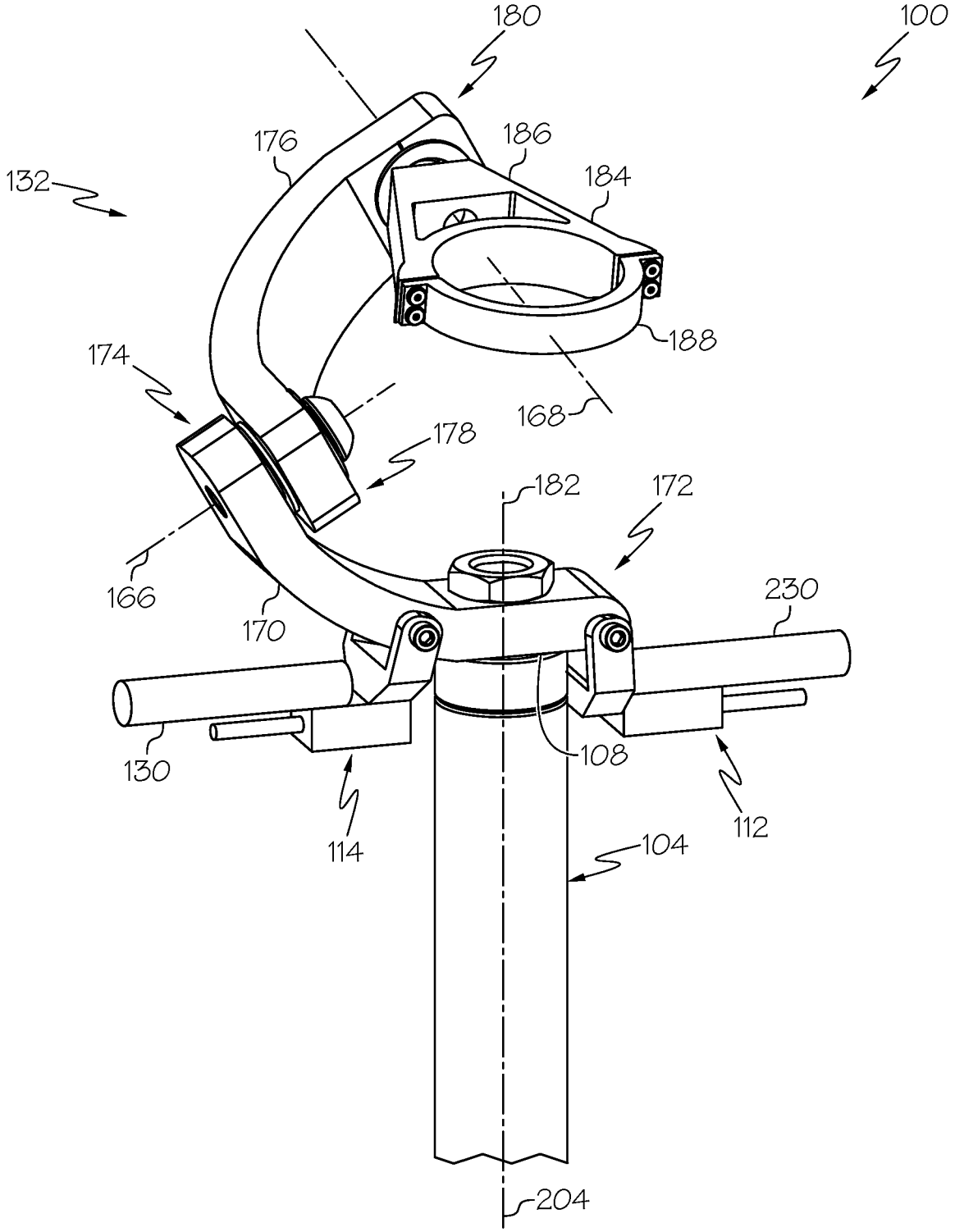
FIG. 9 is a schematic, perspective view of an example of a tool-mount of the surface preparation support apparatus.

Referring to FIGS. 8 and 9, in one or more examples, the apparatus 100 includes a tool-mount 132. The tool-mount 132 is coupled to the tool-end 108 of the linear actuator 104. The tool-mount 132 is configured such that the surface preparation tool 110 can be removably coupled to the tool-mount 132. The surface preparation tool 110 being removable from the tool-mount 132 enables different types of surface preparation tools (e.g., sanders, polishers, grinders, etc.) to be interchanged with each other depending on the desired surface preparation operation being performed.

In one or more examples, the surface preparation tool 110 is pivotally moveable relative to the linear actuator 104. In one or more examples, the tool-mount 132 is configured to enable rotation of the surface preparation tool 110 about at least one axis, such as about two axes. Rotation of the surface preparation tool 110 enables the angular orientation of the surface preparation tool 110 to be automatically adjusted to conform to a profile shape or slope of a non-horizontal portion of the low-profile surface 200 (FIGS. 2 and 4).

In one or more examples, the tool-mount 132 enables rotation of the surface preparation tool 110 about two axes (e.g., a first tool-rotation axis 166 and a second tool-rotation axis 168). In one or more examples, the first tool-rotation axis 166 and the second tool-rotation axis 168 are orthogonal to each other. In one or more examples, each of the first tool-rotation axis 166 and the second tool-rotation axis 168 intersects the translational axis 204 of the linear actuator 104. In one or more examples, the tool-mount 132 also enables rotation of the surface preparation tool 110 about a third tool-rotation axis 182. In one or more examples, the third tool-rotation axis 182 is parallel to or coincident with the translational axis 204 of the linear actuator 104.

In one or more examples, the tool-mount 132 is a gimbal mechanism. In an example, the gimbal mechanism includes a set of (e.g., at least two) single axis gimbals. Each gimbal has a closed cross-sectional shape (e.g., a ring) and is independently moveable relative to each other and enables rotation of the surface preparation tool 110 about one axis. In various examples, any suitable gimbal mechanism is contemplated for use as the tool-mount 132.

In one or more examples, as illustrated in FIGS. 8 and 9, the tool-mount 132 is a half-gimbal mechanism. The half-gimbal mechanism includes a set of (e.g., at least two) single axis gimbal arms. Each gimbal arm is independently moveable relative to the other and enables rotation of the surface preparation tool 110 about one axis. Unlike a traditional gimbal mechanism, the gimbal arms of the half-gimbal mechanism do not require a closed cross-sectional shape in which an outer gimbal is concentric with an inner gimbal and each gimbal has two attachment points with an adjacent gimbal.

In one or more examples, as illustrated in FIGS. 8 and 9, the tool-mount 132 (e.g., the half-gimbal mechanism) includes a first gimbal arm 170, a second gimbal arm 176, and a third gimbal arm 184. In one or more examples, each one of the first gimbal arm 170 and the second gimbal arm 176 has an arcuate (e.g., curved) profile shape. The first gimbal arm 170 is coupled to the tool-end 108 of the linear actuator 104. The second gimbal arm 176 is coupled to the first gimbal arm 170 and is rotatable relative to the first gimbal arm 170 about the first tool-rotation axis 166 (e.g., a roll axis). The third gimbal arm 184 is coupled to the second gimbal arm 176 and is rotatable relative to the second gimbal arm 176 about the second tool-rotation axis 168 (e.g., a tilt axis or pitch axis). The third gimbal arm 184 is configured to hold the surface preparation tool 110 (FIG. 8). In other words, the surface preparation tool 110 is removably coupled to the third gimbal arm 184. In one or more examples, optionally, the first gimbal arm 170 is rotatable relative to the linear actuator 104 about the third tool-rotation axis 182 (e.g., a pan axis).

Referring to FIG. 9, in one or more examples, the first gimbal arm 170 includes a first gimbal arm-first end 172 and a first gimbal arm-second end 174, opposite the first gimbal arm-first end 172. The first gimbal arm-first end 172 is coupled to the tool-end 108 of the linear actuator 104. The second gimbal arm 176 includes a second gimbal arm-first end 178 and a second gimbal arm-second end 180, opposite the second gimbal arm-first end 178. The second gimbal arm-first end 178 is coupled to the first gimbal arm-second end 174. The third gimbal arm 184 is coupled to the second gimbal arm-second end 180.

In one or more examples, the third gimbal arm 184 includes an inner clamp member 186. The inner clamp member 186 is coupled to the second gimbal arm 176, such as to the second gimbal arm-second end 180. The inner clamp member 186 is rotatable relative to the second gimbal arm 176 about the second tool-rotation axis 168. The third gimbal arm 184 also includes an outer clamp member 188. The outer clamp member 188 is configured to be releasably coupled (e.g., fastened) to the inner clamp member 186. The surface preparation tool 110 (FIG. 8) is clamped between the inner clamp member 186 and the outer clamp member 188.

Referring to FIG. 8, in one or more examples, the surface preparation tool 110 includes a tool body 190 (e.g., a tool housing) and a surface preparation head 192, coupled to the tool body 190. A motor (not shown), such as a pneumatic motor, is housed within the tool body 190 and is operatively coupled to the surface preparation head 192 to drive movement (e.g., rotational movement or orbital movement) of the surface preparation head 192. The structure and operation of surface preparation tools and, particularly, pneumatic motors for driving surface preparation heads are known and, therefore, will not be described in further detail.

In one or more examples, the third gimbal arm 184 is configured to be secured to the tool body 190 such that the surface preparation tool 110 is coupled to the second gimbal arm 176. In one or more examples, the tool body 190 of the surface preparation tool 110 is positioned within an open region defined between the inner clamp member 186 and the outer clamp member 188. With the inner clamp member 186 coupled to the outer clamp member 188, the tool body 190 of the surface preparation tool 110 is surrounded by and securely held between the inner clamp member 186 and the outer clamp member 188.

Referring to FIGS. 1-6 and 8-10, in one or more examples, the apparatus 100 includes a tool-control handle 130. In one or more examples, the tool-control handle 130 is coupled to the linear actuator 104. In one or more examples, the tool-control handle 130 is coupled proximate to (e.g., at or near) the tool-end 108 of the linear actuator 104. In one or more examples, the tool-control handle 130 is coupled to the tool-mount 132 (e.g., FIGS. 8 and 9). For example, the tool-control handle 130 is coupled to first gimbal arm 170 of the tool-mount 132. Coupling the tool-control handle 130 near the tool-end 108 of the linear actuator 104 provides the user with increased control and mechanical advantage when moving the surface preparation tool 110 relative to the low-profile surface 200 during the surface preparation operation.

The tool-control handle 130 provides a grip for the user and enables the user to manually pivot the linear actuator 104 about the pivotal-motion axis 116 relative to the creeper 102, to manually rotate the linear actuator 104 about the rotational-motion axis 118 relative to the creeper 102, and to manually move the linear actuator 104 along the linear-motion axis 120 relative to the creeper 102 while the user is positioned on the body pad 154 in the supine position.

As previously described herein, pivoting the linear actuator 104 about the pivotal-motion axis 116 relative to the creeper 102 raises and lowers the surface preparation tool 110 into and out of operational contact with the low-profile surface 200. Rotating the linear actuator 104 about the rotational-motion axis 118 and/or linear movement of the linear actuator 104 along the linear-motion axis 120 relative to the creeper 102 moves the surface preparation tool 110 across the low-profile surface 200 during the surface preparing operation. Thus, the tool-control handle 130 enables the user to manipulate the location and/or orientation of the linear actuator 104 relative to the creeper 102 with one hand, which in turn locates the surface preparation tool 110 relative to the low-profile surface 200.

In one or more examples, the tool-controller 114 is coupled to the tool-control handle 130. In one or more examples, the tool-valve control 136 is coupled to, or is located on, the tool-control handle 130. In one or more examples, the pneumatic tool-valve 134 is also located on, or is proximate to, the tool-control handle 130. Co-locating the tool-controller 114 with the tool-control handle 130 enables the user to control the power supplied to the surface preparation tool 110 while concurrently manipulating the location and orientation of the linear actuator 104 to position the surface preparation tool 110 relative to the low-profile surface 200 using one hand.

Referring to FIGS. 1-6 and 8-10, in one or more examples, the apparatus 100 includes an actuator-control handle 230. In one or more examples, the actuator-control handle 230 is coupled to the linear actuator 104, such as opposite to the tool-control handle 130. In one or more examples, the actuator-control handle 230 is coupled proximate to (e.g., at or near) the tool-end 108 of the linear actuator 104. In one or more examples, the actuator-control handle 230 is coupled to the tool-mount 132 (e.g., FIGS. 8 and 9). For example, the actuator-control handle 230 is coupled to first gimbal arm 170 of the tool-mount 132 opposite to the tool-control handle 130. Coupling the actuator-control handle 230 near the tool-end 108 of the linear actuator 104 provides the user with increased control and mechanical advantage when moving the surface preparation tool 110 relative to the low-profile surface 200 during the surface preparation operation.

The actuator-control handle 230 provides an alternate or additional grip for the user and enables the user to manually pivot the linear actuator 104 about the pivotal-motion axis 116 relative to the creeper 102, to manually rotate the linear actuator 104 about the rotational-motion axis 118 relative to the creeper 102, and to manually move the linear actuator 104 along the linear-motion axis 120 relative to the creeper 102 while the user is positioned on the body pad 154 in the supine position.

As previously described herein, pivoting the linear actuator 104 about the pivotal-motion axis 116 relative to the creeper 102 raises and lowers the surface preparation tool 110 into and out of operational contact with the low-profile surface 200. Rotating the linear actuator 104 about the rotational-motion axis 118 and/or linear movement of the linear actuator 104 along the linear-motion axis 120 relative to the creeper 102 moves the surface preparation tool 110 across the low-profile surface 200 during the surface preparing operation. Thus, the actuator-control handle 230 enables the user to manipulate the location and/or orientation of the linear actuator 104 relative to the creeper 102 with one hand, which in turn locates the surface preparation tool 110 relative to the low-profile surface 200.

In one or more examples, the actuator-controller 112 is coupled to the actuator-control handle 230. In one or more examples, the actuator-valve control 142 is coupled to, or is located on, the actuator-control handle 230. In one or more examples, the pneumatic actuator-valve 140 is also located on, or is proximate to, the actuator-control handle 230. Co-locating the actuator-controller 112 with the actuator-control handle 230 enables the user to control the power supplied to the linear actuator 104 while concurrently manipulating the location and orientation of the linear actuator 104 to position the surface preparation tool 110 relative to the low-profile surface 200 using one hand.

In one or more examples, as illustrated in FIGS. 1-6, 8 and 9, the apparatus 100 includes both the tool-control handle 130 and the actuator-control handle 230. The tool-control handle 130 and actuator-control handle 230, in combination, enables the user to use both hands to control manipulation of the location and/or orientation of the linear actuator 104 relative to the creeper 102, which in turn locates the surface preparation tool 110 relative to the low-profile surface 200, while concurrently enabling the user to control the power supplied to the surface preparation tool 110 using one hand and to control the power supplied to the linear actuator 104 using the other hand.

Figure 10:
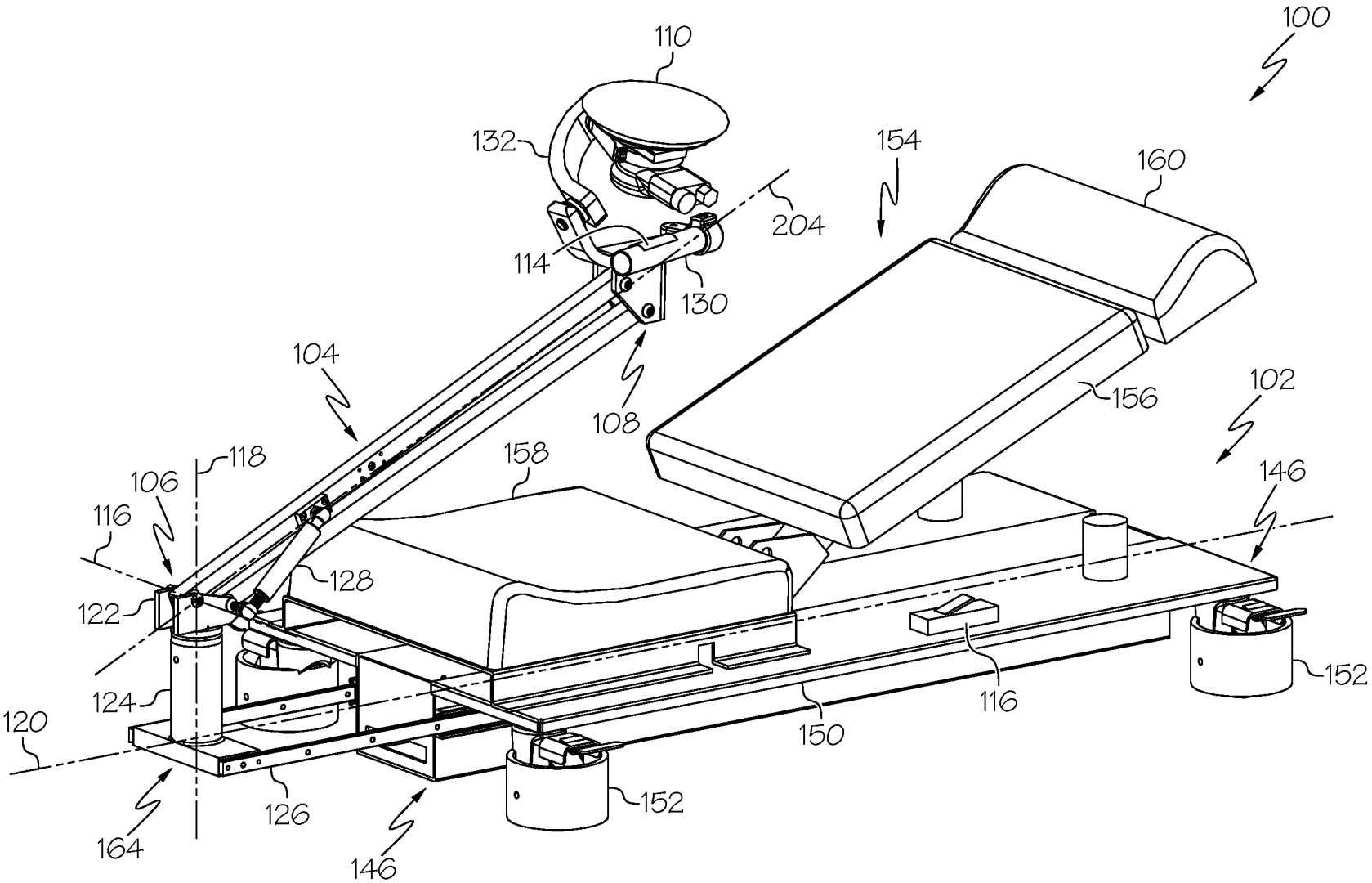
FIG. 10 is a schematic, perspective view of an example of the surface preparation support apparatus.

As illustrated in FIG. 10, alternatively, in one or more examples, the actuator-controller 112 is coupled to the creeper 102, rather than to a control handle (e.g., the actuator-control handle 230). In one or more examples, the actuator-valve control 142 is coupled to, or is located on, the frame 150 of the creeper 102 in reach of the user. In one or more examples, the pneumatic actuator-valve 140 is also coupled to, or is located on, the frame 150 of the creeper 102. Generally, the actuator-controller 112 is located on the frame 150 of the creeper 102 within reach of the user to enable the user to control the power supplied to the linear actuator 104 with one hand, while concurrently controlling the power supplied to the surface preparation tool 110 and manipulating the location and orientation of the linear actuator 104 with the opposite hand, such as via the tool-control handle 130.

Alternatively, in one or more examples, the tool-controller 114 is coupled to the creeper 102, rather than to a control handle (e.g., the tool-control handle 130). In one or more examples, the tool-valve control 136 is coupled to, or is located on, the frame 150 of the creeper 102 in reach of the user. In one or more examples, the pneumatic tool-valve 134 is also coupled to, or is located on, the frame 150 of the creeper 102. Generally, the tool-controller 114 is located on the frame 150 of the creeper 102 within reach of the user to enable the user to control the power supplied to the surface preparation tool 110 with one hand, while concurrently controlling the power supplied to the linear actuator 104 and manipulating the location and orientation of the linear actuator 104 with the opposite hand, such as via the actuator-control handle 230.

In one or more examples, the pressure regulator 194 and the manifold 198 are coupled to the frame 150 of the creeper 102. In one or more examples, the compress air source 162 is located remotely from the apparatus 100 and is coupled to and is in fluid communication with the manifold 198 via a pneumatic line.

In one or more examples, the tool-controller 114 and/or the tool-control handle 130 are located on one side (e.g., the left side) of the apparatus 100 to be manipulated by one hand (e.g., the left hand) of the user. In these examples, the actuator-controller 112 and/or the actuator-control handle 230 are located on an opposing side (e.g., the right side) of the apparatus 100 to be manipulated on an opposite hand (e.g., the right hand) of the user.

In an example implementation, the user adjusts the height (e.g., raises and lowers) the surface preparation tool 110 into and out of operational contact with the low-profile surface 200 using actuation of the linear actuator 104 using a first hand (e.g., one of the left or right hands). With the surface preparation tool 110 in contact with the low-profile surface 200, the user energizes the surface preparation tool 110 using a second hand (e.g., the other one of the left or right hands). With the surface preparation tool 110 in contact with the low-profile surface 200, the user moves the surface preparation tool 110 across the low-profile surface 200 by rotating the linear actuator 104 and/or linearly moving the linear actuator 104 relative to the creeper 102 using one or both of the first hand and/or the second hand.

Figure 11:
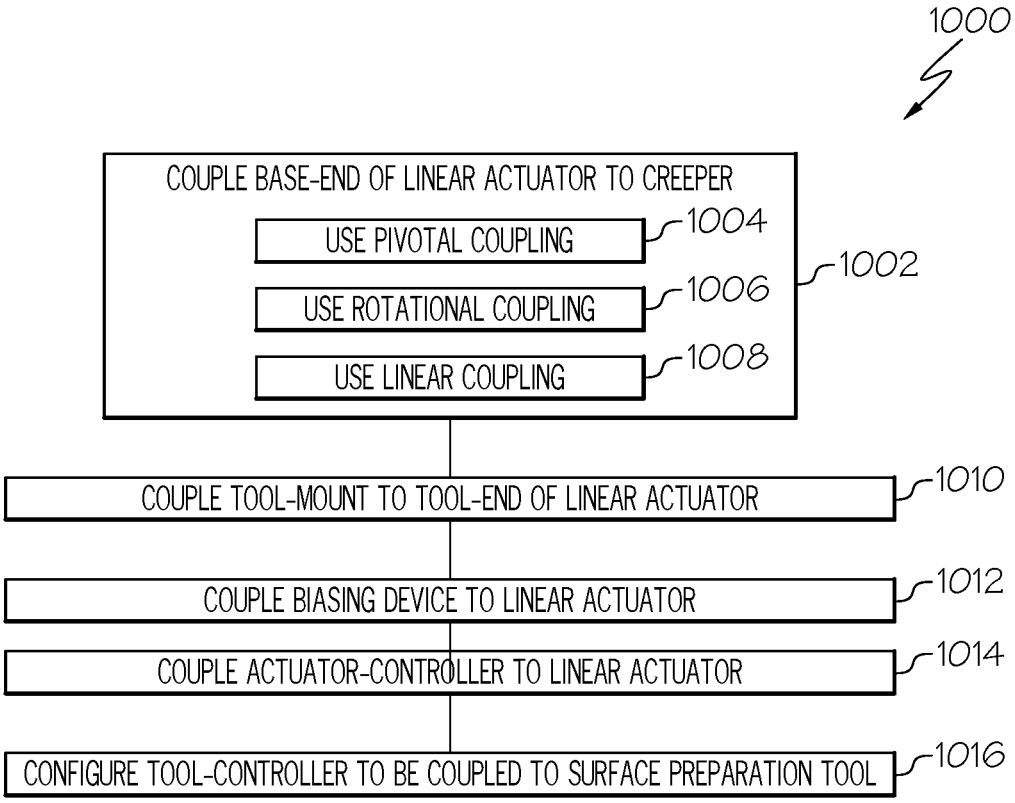
FIG. 11 is a flow diagram of an example of a method of making a surface preparation support apparatus.

Referring to FIG. 11, by way of examples, the present disclosure is further directed to a method 1000 of making the surface preparation support apparatus 100 (FIGS. 1-10).

In one or more examples, the method 1000 includes a step of (block 1002) coupling the base-end 106 of the linear actuator 104 to the creeper 102. In one or more examples, the base-end 106 of the linear actuator 104 is coupled to the creeper 102 via the movable joint 164 such that the linear actuator 104 is at least one of pivotable, rotatable, and linearly movable relative to the creeper 102. In one or more examples, the base-end 106 of the linear actuator 104 is coupled to the creeper 102 via at least one of the pivotal coupling 122, the rotational coupling 124, and the linear coupling 126.

In one or more examples, the step of (block 1002) coupling the base-end 106 of the linear actuator 104 to the creeper 102 includes a step of coupling the base-end 106 of the linear actuator 104 to the foot-end 148 the creeper 102.

In one or more example, the step of (block 1002) coupling the base-end 106 of the linear actuator 104 to the creeper 102 is performed using the pivotal coupling 122 (block 1004). In one or more examples, the step of (block 1002) coupling the base-end 106 of the linear actuator 104 to the creeper 102, using the pivotal coupling 122 (block 1004), includes a step of coupling the pivotal coupling 122 to the creeper 102 and a step of coupling the base-end 106 of the linear actuator 104 to the pivotal coupling 122 so that the linear actuator 104 is pivotally movable relative to the creeper 102 about the pivotal-motion axis 116 of the pivotal coupling 122.

In one or more examples, the step of (block 1002) coupling the base-end 106 of the linear actuator 104 to the creeper 102 is performed using the rotational coupling 124 (block 1006). In one or more examples, the step of (block 1002) coupling the base-end 106 of the linear actuator 104 to the creeper 102, using the rotational coupling 124 (block 1006), includes a step of coupling the rotational coupling 124 to the creeper 102 and a step of coupling the base-end 106 of the linear actuator 104 to the rotational coupling 124 so that the linear actuator 104 is rotationally movable relative to the creeper 102 about the rotational-motion axis 118 of the rotational coupling 124.

In one or more examples, the step of (block 1002) coupling the base-end 106 of the linear actuator 104 to the creeper 102 is performed using the linear coupling 126 (block 1008). In one or more examples, the step of (block 1002) coupling the base-end 106 of the linear actuator 104 to the creeper 102, using the linear coupling 126 (block 1008), includes a step of coupling the linear coupling 126 to the creeper 102 and a step of coupling the base-end 106 of the linear actuator 104 to the linear coupling 126 so that the linear actuator 104 is linearly movable relative to the creeper 102 about a linear-motion axis 120 of the linear coupling 126.

In one or more examples, the base-end 106 of the linear actuator 104 is coupled to the creeper 102 via a combination of the pivotal coupling 122, the rotational coupling 124, and the linear coupling 126. In one or more examples, the step of (block 1002) coupling the base-end 106 of the linear actuator 104 to the creeper 102 is performed using the pivotal coupling 122 (block 1004), using the rotational coupling (block 1006), and using the linear coupling 126 (block 1008).

In one or more examples, the step of (block 1002) coupling the base-end 106 of the linear actuator 104 to the creeper 102, using the linear coupling 126 (block 1008), includes a step of coupling the linear coupling 126 to the creeper 102. The step of (block 1002) coupling the base-end 106 of the linear actuator 104 to the creeper 102, using the rotational coupling 124 (block 1006), includes a step of coupling the rotational coupling 124 to the linear coupling 126. The step of (block 1002) coupling the base-end 106 of the linear actuator 104 to the creeper 102, using the pivotal coupling 122 (block 1004), includes a step of coupling the pivotal coupling 122 to the rotational coupling 124. The step of (block 1002) coupling the base-end 106 of the linear actuator 104 to the creeper 102 also includes a step of coupling the base-end 106 of the linear actuator 104 to the pivotal coupling 122 so that the linear actuator 104 is pivotally movable relative to the creeper 102 about the pivotal-motion axis 116 of the pivot coupling 122, is rotationally movable relative to the creeper 102 about the rotational-motion axis 118 of the rotational coupling 124, and is linearly movable relative to the creeper 102 along the linear-motion axis 120 of the linear coupling 126.

In one or more examples, the method 1000 includes a step of coupling the tool-control handle 130 to the linear actuator 104 such that manual manipulation of the linear actuator 104 can be performed using one hand via the tool-control handle 130. Alternatively, in one or more examples, the method 1000 includes a step of coupling the actuator-control handle 230 to the linear actuator 104 such that manual manipulation of the linear actuator 104 can be performed using one hand via the actuator-control handle 230. Alternatively, in one or more examples, the method 1000 includes a step of coupling the tool-control handle 130 to the linear actuator 104 and coupling the actuator-control handle 230 to the linear actuator 104 such that manual manipulation of the linear actuator 104 can be performed using both hands, via the tool-control handle 130 and the actuator-control handle 230.

In one or more examples, the method 1000 includes a step of (block 1010) coupling the tool-mount 132 to the tool-end 108 of the linear actuator 104. The tool-mount 132 is configured for attachment of the surface preparation tool 110.

In one or more examples, the method 1000 includes a step of (block 1012) coupling the biasing device 128 to the linear actuator 104. In one or more examples, the step of (block 1012) coupling the biasing device 128 to the linear actuator 104 includes a step of coupling the biasing device 128 to the pivotal coupling 122 and to the linear actuator 104. The biasing device 128 is configured to bias the linear actuator 104 at the biased angular orientation relative to the horizontal plane.

In one or more examples, the method 1000 includes a step of (block 1014) coupling the actuator-controller 112 with the linear actuator 104. The actuator-controller 112 is operationally coupled with the linear actuator 104. The actuator-controller 112 is operable (e.g., configured) to selectively actuate the linear actuator 104 such that the tool-end 108 of the linear actuator 104 moves relative to the base-end 106 of the linear actuator 104.

In one or more examples, the step of (block 1014) coupling the actuator-controller 112 to the linear actuator 104 includes a step of operationally coupling the pneumatic actuator-valve 140 of the actuator-controller 112 with the linear actuator 104. The pneumatic actuator-valve 140 is operable (e.g., configured) to actuate between the open position, in which the flow of pressurized air is supplied to the linear actuator 104, and the closed position, in which the flow of pressurized air is restricted from the linear actuator 104, via the actuator-valve control 142.

In one or more examples, the step of (block 1014) coupling the actuator-controller 112 to the linear actuator 104 also includes a step of coupling the actuator-valve control 142 of the actuator-controller 112 to the pneumatic actuator-valve 140. The actuator-valve control 142 is configured to selectively actuate the pneumatic actuator-valve 140 between the open position and the closed position.

In one or more examples, the step of (block 1014) coupling the actuator-controller 112 to the linear actuator 104 includes a step of coupling the actuator-biasing mechanism 144 to the pneumatic actuator-valve 140. The actuator-biasing mechanism 144 is configured to bias the pneumatic actuator-valve 140 in the closed position.

In one or more examples, the step of (block 1014) coupling the actuator-controller 112 to the linear actuator 104 includes a step of coupling the actuator-controller 112, such as the actuator-valve control 142 and/or the pneumatic actuator-valve 140, to the actuator-control handle 230 such that manual manipulation of the linear actuator 104 and selective control of the linear actuator 104 can be performed using one hand. Alternatively, the actuator-controller 112, such as the actuator-valve control 142 and/or the pneumatic actuator-valve 140, is coupled to the frame 150 of the creeper 102 such that selective control of the linear actuator 104 can be performed using one hand.

In one or more examples, the method 1000 includes a step of (block 1016) configuring the tool-controller 114 to be coupled to the surface preparation tool 110. For example, the step of (block 1016) configuring the tool-controller 114 to be coupled to the surface preparation tool 110 includes a step of operationally coupling the tool-controller 114 with the surface preparation tool 110. The tool-controller 114 is operable (e.g., configured) to selectively energize the surface preparation tool 110.

The pneumatic tool-valve 134 is configured to be operationally coupled with the surface preparation tool 110. In one or more examples, the step of (block 1016) configuring the tool-controller 114 to be coupled to the surface preparation tool 110 includes a step of operationally coupling the pneumatic tool-valve 134 of the tool-controller 114 with the surface preparation tool 110. The pneumatic tool-valve 134 is operable (e.g., configured) to actuate between the open position, in which the flow of pressurized air is supplied to the surface preparation tool 110, and the closed position, in which the flow of pressurized air is restricted from the surface preparation tool 110, via the tool-valve control 136.

In one or more examples, the step of (block 1016) configuring the tool-controller 114 to be coupled to the surface preparation tool 110 also includes a step of coupling the tool-valve control 136 of the tool-controller 114 to the pneumatic tool-valve 134. The tool-valve control 136 is configured to selectively actuate the pneumatic tool-valve 134 between the open position and the closed position.

In one or more examples, the step of (block 1016) configuring the tool-controller 114 to be coupled to the surface preparation tool 110 includes a step of coupling the tool-biasing mechanism 138 to the pneumatic tool-valve 134. The tool-biasing mechanism 138 is configured to bias the pneumatic tool-valve 134 in the closed position.

In one or more examples, the step of (block 1016) configuring the tool-controller 114 to be coupled to the surface preparation tool 110 includes a step of coupling the tool-controller 114, such as the tool-valve control 136 and/or the pneumatic tool-valve 134, to the tool-control handle 130 such that manual manipulation of the linear actuator 104 and selective control of the surface preparation tool 110 can be performed using one hand. Alternatively, the tool-controller 114, such as the tool-valve control 136 and/or the pneumatic tool-valve 134, is coupled to the frame 150 of the creeper 102 such that selective control of the surface preparation tool 110 can be performed using one hand.

Figure 12:
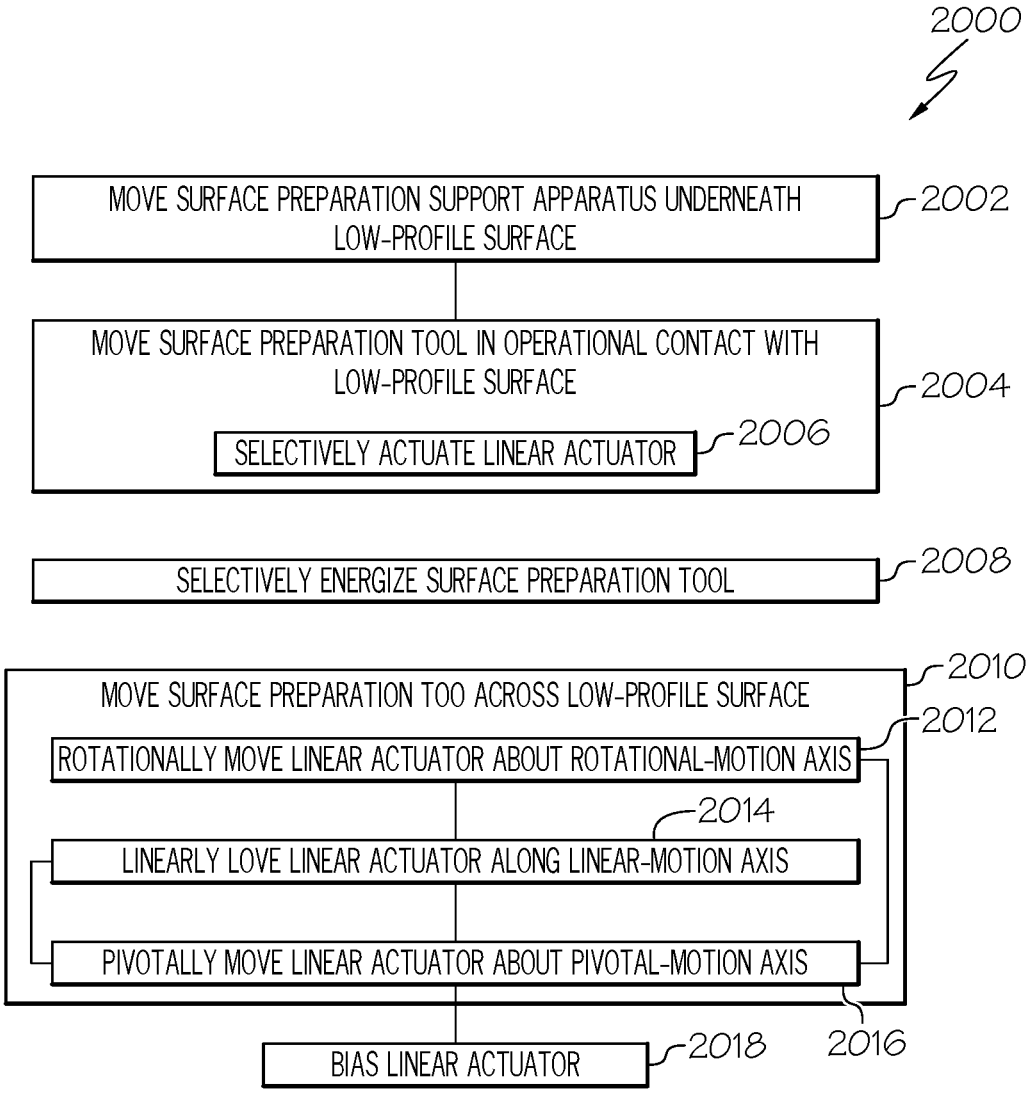
FIG. 12 is a flow diagram of an example of a method of preparing a low-profile surface.

Referring to FIG. 12, by way of examples, the present disclosure is further directed to a method 2000 of preparing the low-profile surface 200. Examples of the disclosed method 2000 are performed using the surface preparation support apparatus 100 (FIGS. 1-9). The disclosed method 2000 enables support and mobility of the surface preparation tool 110, controlled by the user, while the user is in the supine position and is performing the surface preparation operation on the low-profile surface 200. The disclosed method 2000 mitigates safety and ergonomic challenges associated with surface preparation operations of low-profile surfaces.

In one or more examples, the method 2000 includes a step of (block 2002) moving the apparatus 100 underneath the low-profile surface 200. For example, while supported by the creeper 102 in the supine position and with the legs of the user in contact with the work floor, the user can manually maneuver the creeper 102 in one or more directions using the legs. In one or more examples, the method 2000 includes a step of maneuvering the creeper 102 underneath the low-profile surface 200 to position the surface preparation tool 110 underneath the low-profile surface 200. In one or more examples, the method 1000 includes a step of selectively actuating the linear actuator 104, coupled to the creeper 102, to position the surface preparation tool 110 proximate to (e.g., at or near) the low-profile surface 200.

In one or more examples, the method 2000 includes a step of (block 2004) moving the surface preparation tool 110 into operational contact with the low-profile surface 200. In one or more examples, the step of (block 2004) moving the surface preparation tool 110 into operational contact with the low-profile surface 200 includes a step of (block 2006) selectively actuating the linear actuator 104 to linearly move the tool-end 108 of the linear actuator 104 away from the base-end 106 of the linear actuator 104. Extension of the linear actuator 104 raises the surface preparation tool 110, coupled to the tool-end 108 of the linear actuator 104, into operational contact with the low-profile surface 200. In these examples, actuation (e.g., extension) of the linear actuator 104 places the surface preparation tool 110 in operational contact with the low-profile surface 200 and holds the surface preparation tool 110 in operational contact with the low-profile surface 200.

In one or more examples, the step of (block 2006) selectively actuating the linear actuator 104 includes a step of engaging the actuator-controller 112 to extend the linear actuator 104. In one or more examples, the step of (block 2006) selectively actuating the linear actuator 104 includes a step of disengaging the actuator-controller 112 to automatically retract (e.g., de-actuate) the linear actuator 104.

The actuator-controller 112 is operable (e.g., configured) to selectively actuate the linear actuator 104. In one or more examples, the actuator-controller 112 is situated on (e.g., coupled to) the linear actuator 104, such as to the actuator-control handle 230. In one or more examples, the actuator-controller 112 is situated on (e.g., coupled to) the creeper 102, such as to the frame 150.

In one or more examples, the step of (block 2004) moving the surface preparation tool 110 into operational contact with the low-profile surface 200 includes a step of pivotally moving the linear actuator 104 relative to the creeper 102 about the pivotal-motion axis 116 of the pivotal coupling 122 that couples the base-end 106 of the linear actuator 104 to the creeper 102. Pivotally moving the linear actuator 104 raises the surface preparation tool 110 into operational contact with the low-profile surface 200. In these examples, a user force, applied by the user to the linear actuator 104, places the surface preparation tool 110 in operational contact with the low-profile surface 200 and holds the surface preparation tool 110 in operational contact with the low-profile surface 200.

In one or more examples, the method 2000 includes a step of (block 2008), with the surface preparation tool 110 in operational contact with the low-profile surface 200, selectively energizing the surface preparation tool 110.

In one or more examples, the step of (block 2008) selectively energizing the surface preparation tool 110 includes a step of engaging the tool-controller 114 that is coupled to the surface preparation tool 110 to energize the surface preparation tool 110. In one or more examples, the step of (block 2008) selectively energizing the surface preparation tool 110 includes a step of disengaging the tool-controller 114 to automatically deenergize the surface preparation tool 110.

The tool-controller 114 is operable (e.g., configured) to selectively energize the surface preparation tool 110. In one or more examples, the tool-controller 114 is situated on (e.g., coupled to) the linear actuator 104, such as to the tool-control handle 130. In one or more examples, the tool-controller 114 is situated on (e.g., coupled to) the creeper 102, such as to the frame 150.

In one or more examples, the method 2000 includes a step of (block 2010), with the surface preparation tool 110 in contact with the low-profile surface 200 and energized, moving the surface preparation tool 110 across the low-profile surface 200 to perform the surface preparation operation on the low-profile surface 200.

In one or more examples, the step of (block 2010) moving the surface preparation tool 110 across the low-profile surface 200 includes a step of (block 2012) rotationally moving the linear actuator 104 relative to the creeper 102 about the rotational-motion axis 118 of the rotational coupling 124 that couples the base-end 106 of the linear actuator 104 to the creeper 102. Rotationally moving the linear actuator 104 relative to the creeper 102 about the rotational-motion axis 118 moves the surface preparation tool 110 across the low-profile surface 200 (e.g., side-to-side).

In one or more examples, the step of (block 2010) moving the surface preparation tool 110 across the low-profile surface 200 includes a step of (block 2014) linearly moving the linear actuator 104 relative to the creeper 102 along the linear-motion axis 120 of the linear coupling 126 that couples the base-end 106 of the linear actuator 104 to the creeper 102. Linearly moving the linear actuator 104 relative to the creeper 102 along the linear-motion axis 120 moves the surface preparation tool 110 across the low-profile surface 200 (e.g., front-to-back).

In one or more examples, the step of (block 2010) moving the surface preparation tool 110 across the low-profile surface 200 includes a step of (block 2016) pivotally moving the linear actuator 104 relative to the creeper 102 about the pivotal-motion axis 116 of the pivotal coupling 122 that couples the base-end 106 of the linear actuator 104 to the creeper 102. Pivotally moving the linear actuator 104 raises or lowers the surface preparation tool 110 to accommodate for changes in geometry of the low-profile surface 200 and to keep the surface preparation tool 110 in operational contact with the low-profile surface 200. In these examples, the user force, applied by the user to the linear actuator 104, holds the surface preparation tool 110 in operational contact with the low-profile surface 200 as the geometry of the low-profile surface 200 changes. In these examples, the user force, applied by the user to the linear actuator 104, temporarily removes the surface preparation tool 110 from operational contact with the low-profile surface 200 to avoid obstructions on the low-profile surface 200.

In one or more examples, the step of (block 2012) rotationally moving the linear actuator 104 and the step of (block 2014) linearly moving the linear actuator 104 are performed concurrently. In one or more examples, the step of (block 2016) pivotally moving the linear actuator 104 is performed concurrently with at least one of the step of (block 2012) rotationally moving the linear actuator 104 and the step of (block 2014) linearly moving the linear actuator 104.

In one or more examples, the method 2000 includes a step of (block 2018) biasing the linear actuator 104 at the biased angular orientation relative to the horizontal plane using the biasing device 128 that is coupled to the movable joint 164, such as the pivotal coupling 122, and to the linear actuator 104. Biasing the linear actuator 104 at the biased angular orientation also biases the linear actuator 104 and, thus, the surface preparation tool 110 toward the low-profile surface 200 when the linear actuator 104 is pivoted downwardly, such as in response to variations on the geometry of the low-profile surface 200. In these examples, the bias force, applied by the biasing device 128 to the linear actuator 104, holds the surface preparation tool 110 in operational contact with the low-profile surface 200 as the geometry of the low-profile surface 200 changes.

Biasing the linear actuator 104 at the biased angular orientation also biases the linear actuator 104 and, thus, the surface preparation tool 110 away from the creeper 102 and, thus, the user, which serves as a safety mechanism that prevents the linear actuator 104 and/or the surface preparation tool 110 from falling into the creeper 102 or the user when the linear actuator 104 isn't being actively held or controlled by the user.

By way of the illustrative examples, the disclosed apparatus 100 is pneumatically powered. However, the disclosed apparatus 100 is not necessarily limited to pneumatic power. In one or more other examples, where appropriate, one or more pneumatic components may be replaced or interchanged with electro-mechanical components and/or hydraulic components. Accordingly, it should be appreciated that one or more pneumatic components of the apparatus 100, such as one or more pneumatic components of the linear actuator 104, the actuator-controller 112, and/or the tool-controller 114, may be omitted or interchanged with one or more suitable electro-mechanical components and/or hydraulic components where appropriate.

Example implementations described herein may relate to surface preparation of an underside or underbelly structure of an aircraft. More specifically, the surface preparation support apparatuses and methods of making and operating the same may be implemented by an original equipment manufacturer (OEM) for assembling airplane structures in compliance with military and space regulations.

Figure 13:
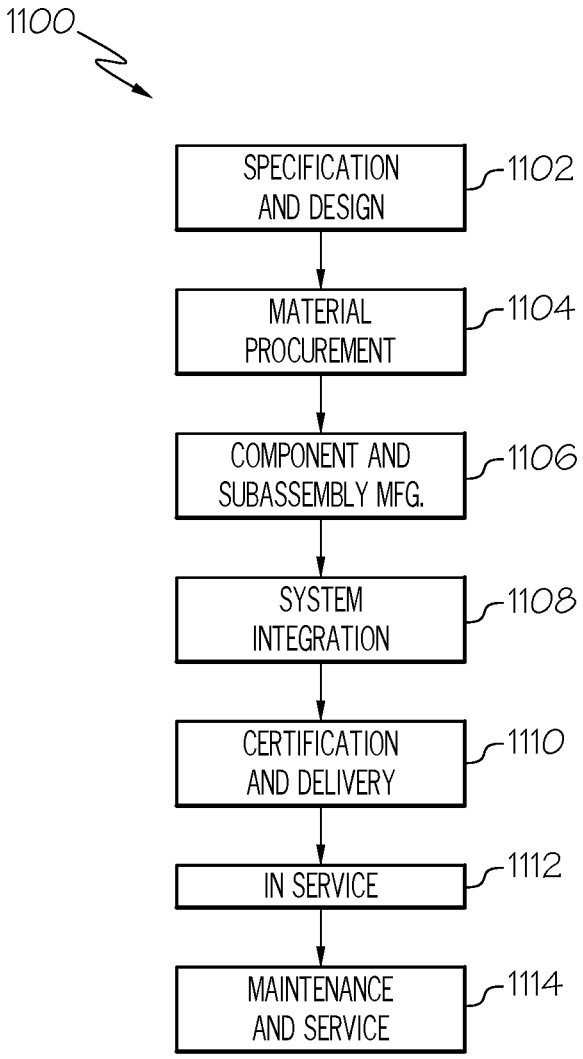
FIG. 13 is a flow diagram of an aircraft manufacturing and service methodology.
Figure 14:
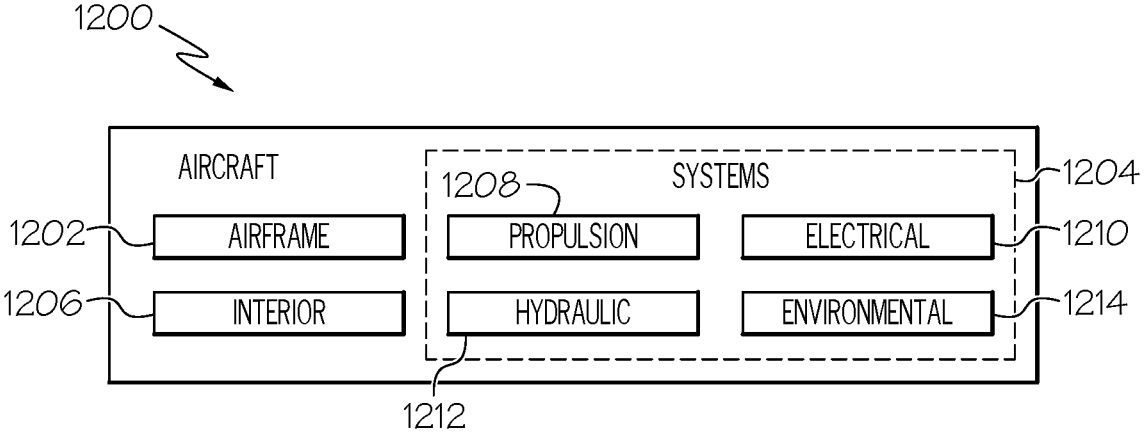
FIG. 14 is a schematic block diagram of an example of an aircraft.

Referring now to FIGS. 13 and 14 examples of the surface preparation support apparatus 100, the method 1000, and the method 2000 may be used in the context of an aircraft manufacturing and service method 1100, as shown in the flow diagram of FIG. 13 and an aircraft 1200, as schematically illustrated in FIG. 14.

Referring to FIG. 14, in one or more examples, the aircraft 1200 includes an airframe 1202, an interior 1206, and a plurality of high-level systems 1204. Examples of the high-level systems 1204 include one or more of a propulsion system 1208, an electrical system 1210, a hydraulic system 1212, and an environmental system 1214. In other examples, the aircraft 1200 may include any number of other types of systems, such as a communications system, a guidance system, and the like. The surface preparation support apparatus 100 designed and made in accordance with the method 1000 and used in accordance with the method 2000 may be utilized during one or more surface preparation operations performed on a structure, an assembly, a sub-assembly, a component, a part, or any other portion of the aircraft 1200, such as a portion of the airframe 1202, such as a portion of the fuselage or the wings of the aircraft 1200.

Referring to FIG. 13 during pre-production, the method 1100 includes specification and design of the aircraft 1200 (block 1102) and material procurement (block 1104). During production of the aircraft 1200, component and subassembly manufacturing (block 1106) and system integration (block 1108) of the aircraft 1200 take place. Thereafter, the aircraft 1200 goes through certification and delivery (block 1110) to be placed in service (block 1112). Routine maintenance and service (block 1114) includes modification, reconfiguration, refurbishment, etc. of one or more systems of the aircraft 1200.

Each of the processes of the method 1100 illustrated in FIG. 13 may be performed or carried out by a system integrator, a third party, and/or an operator (e.g., a customer). For the purposes of this description, a system integrator may include, without limitation, any number of spacecraft manufacturers and major-system subcontractors; a third party may include, without limitation, any number of vendors, subcontractors, and suppliers; and an operator may be an airline, leasing company, military entity, service organization, and so on.

Examples of the surface preparation support apparatus 100 and the method 2000 shown and described herein may be employed during any one or more of the stages of the manufacturing and service method 1100 shown in the flow diagram illustrated by FIG. 13. In an example, implementation of the disclosed surface preparation support apparatus 100 and the method 2000 may form a portion of component and subassembly manufacturing (block 1106) and/or system integration (block 1108). For example, assembly of the aircraft 1200 and/or components thereof using implementations of the disclosed surface preparation support apparatus 100 and the method 2000 may correspond to component and subassembly manufacturing (block 1106) and may be prepared in a manner similar to components or subassemblies prepared while the aircraft 1200 is in service (block 1112). Also, implementations of the disclosed surface preparation support apparatus 100 and the method 2000 may be utilized during system integration (block 1108) and certification and delivery (block 1110). Similarly, implementations of the disclosed surface preparation support apparatus 100 and the method 2000 may be utilized, for example and without limitation, while the aircraft 1200 is in service (block 1112) and during maintenance and service (block 1114).

Although an aerospace (e.g., aircraft or spacecraft) example is shown, the examples and principles disclosed herein may be applied to other industries, such as the automotive industry, the construction industry, the wind turbine industry, and other design and manufacturing industries. Accordingly, in addition to aircraft and spacecraft, the examples and principles disclosed herein may apply to surface preparation of other vehicles (e.g., land vehicles, marine vehicles, construction vehicles, etc.), machinery, and stand-alone structures that have a low-profile surface.

As used herein, a system, apparatus, device, structure, article, element, component, or hardware "configured to" perform a specified function is indeed capable of performing the specified function without any alteration, rather than merely having potential to perform the specified function after further modification. In other words, the system, apparatus, device, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware that enable the system, apparatus, structure, article, element, component, or hardware to perform the specified function without further modification. For purposes of this disclosure, a system, apparatus, device, structure, article, element, component, or hardware described as being "configured to" perform a particular function may additionally or alternatively be described as being "adapted to" and/or as being "operative to" perform that function.

Unless otherwise indicated, the terms "first," "second," "third," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

For the purpose of this disclosure, the terms "coupled," "coupling," and similar terms refer to two or more elements that are joined, linked, fastened, attached, connected, put in communication, or otherwise associated (e.g., mechanically, electrically, fluidly, optically, electromagnetically) with one another. In various examples, the elements may be associated directly or indirectly. As an example, element A may be directly associated with element B. As another example, element A may be indirectly associated with element B, for example, via another element C. It will be understood that not all associations among the various disclosed elements are necessarily represented. Accordingly, couplings other than those depicted in the figures may also exist.

As used herein, the term "approximately" refers to or represent a condition that is close to, but not exactly, the stated condition that still performs the desired function or achieves the desired result. As an example, the term "approximately" refers to a condition that is within an acceptable predetermined tolerance or accuracy. For example, the term "approximately" refers to a condition that is within 10% of the stated condition. However, the term "approximately" does not exclude a condition that is exactly the stated condition.

Those skilled in the art will appreciate that some of the elements, features, and/or components described and illustrated in FIGS. 1-10 and 14, referred to above, may be combined in various ways without the need to include other features described and illustrated in FIGS. 1-10 and 14, other drawing figures, and/or the accompanying disclosure, even though such combination or combinations are not explicitly illustrated herein. Similarly, additional features not limited to the examples presented, may be combined with some or all of the features shown and described herein. Unless otherwise explicitly stated, the schematic illustrations of the examples depicted in FIGS. 1-10 and 14, referred to above, are not meant to imply structural limitations with respect to the illustrative example. Rather, although one illustrative structure is indicated, it is to be understood that the structure may be modified when appropriate. Accordingly, modifications, additions and/or omissions may be made to the illustrated structure. Additionally, those skilled in the art will appreciate that not all elements described and illustrated in FIGS. 1-10 and 14, referred to above, need be included in every example and not all elements described herein are necessarily depicted in each illustrative example.

In FIGS. 11-13, referred to above, the blocks may represent operations, steps, and/or portions thereof and lines connecting the various blocks do not imply any particular order or dependency of the operations or portions thereof. It will be understood that not all dependencies among the various disclosed operations are necessarily represented. FIGS. 11-13, referred to above, and the accompanying disclosure describing the operations of the disclosed methods set forth herein should not be interpreted as necessarily determining a sequence in which the operations are to be performed. Rather, although one illustrative order is indicated, it is to be understood that the sequence of the operations may be modified when appropriate. Accordingly, modifications, additions and/or omissions may be made to the operations illustrated and certain operations may be performed in a different order or simultaneously. Additionally, those skilled in the art will appreciate that not all operations described need be performed.

Further, references throughout the present specification to features, advantages, or similar language used herein do not imply that all of the features and advantages that may be realized with the examples disclosed herein should be, or are in, any single example. Rather, language referring to the features and advantages is understood to mean that a specific feature, advantage, or characteristic described in connection with an example is included in at least one example. Thus, discussion of features, advantages, and similar language used throughout the present disclosure may, but do not necessarily, refer to the same example.

The described features, advantages, and characteristics of one example may be combined in any suitable manner in one or more other examples. One skilled in the relevant art will recognize that the examples described herein may be practiced without one or more of the specific features or advantages of a particular example. In other instances, additional features and advantages may be recognized in certain examples that may not be present in all examples. Furthermore, although various examples of the surface preparation support apparatus 100 and the methods 1000 and 2000 have been shown and described, modifications may occur to those skilled in the art upon reading the specification. The present application includes such modifications and is limited only by the scope of the claims.

What is claimed is:

1. A surface preparation support apparatus comprising:
- a creeper;
- a linear actuator comprising:
  - a base-end coupled to the creeper; and
  - a tool-end opposite the base-end and linearly movable relative to the base-end;
- a surface preparation tool that is coupleable to the tool-end of the linear actuator;
- an actuator-controller coupled to the linear actuator, wherein the actuator-controller is operable to selectively actuate the linear actuator; and
- a tool-controller configured to be coupled to a surface preparation tool that is coupleable to the tool-end of the linear actuator, wherein the tool-controller is operable to selectively energize the surface preparation tool.

2. The apparatus of claim 1, wherein the linear actuator is pivotally movable relative to the creeper about a pivotal-motion axis that is approximately horizontal.

3. The apparatus of claim 2, further comprising a pivotal coupling coupled to the creeper and forming the pivotal-motion axis, wherein the base-end of the linear actuator is coupled to the pivotal coupling.

4. The apparatus of claim 3, further comprising a biasing device coupled to the pivotal coupling and the linear actuator, wherein the biasing device is configured to bias the linear actuator at a biased angular orientation relative to a horizontal plane.

5. The apparatus of claim 1, wherein the linear actuator is rotationally movable relative to the creeper about a rotational-motion axis that is approximately vertical.

6. The apparatus of claim 5, further comprising a rotational coupling coupled to the creeper and forming the rotational-motion axis, wherein the base-end of the linear actuator is coupled to the rotational coupling.

7. The apparatus of claim 1, wherein the linear actuator is linearly movable relative to the creeper along a linear-motion axis that is approximately horizontal.

8. The apparatus of claim 7, further comprising a linear coupling coupled to the creeper and forming the linear-motion axis, wherein the base-end of the linear actuator is coupled to the linear coupling.

9. The apparatus of claim 1, further comprising:

a rotational coupling coupled to the creeper and having a rotational-motion axis; and a pivotal coupling coupled to the rotational coupling and having a pivotal-motion axis; and wherein:

the base-end of the linear actuator is coupled to the pivotal coupling;

the linear actuator is pivotally movable about the pivotal-motion axis relative to the creeper; and the linear actuator is rotationally movable about the rotational-motion axis relative to the creeper.

10. The apparatus of claim 9, further comprising a biasing device coupled to the pivotal coupling and the linear actuator, wherein the biasing device is configured to bias the linear actuator at a biased angular orientation relative to a horizontal plane.

11. The apparatus of claim 9, further comprising a linear coupling coupled to the creeper and having a linear-motion axis; and wherein:

the rotational coupling is coupled to the linear coupling; and the linear actuator is linearly movable along the linear-motion axis relative to the creeper.

12. A surface preparation support apparatus comprising:

a creeper;

a linear actuator comprising:

a base-end coupled to the creeper; and a tool-end opposite the base-end and linearly movable relative to the base-end;

a tool-mount coupled to the tool-end of the linear actuator, wherein a surface preparation tool is coupleable to the tool-mount;

an actuator-controller coupled to the linear actuator and operable to selectively actuate the linear actuator; and a tool-controller configured to be coupled to the surface preparation tool and operable to selectively energize the surface preparation tool.

13. The apparatus of claim 12, further comprising:

a rotational coupling coupled to the creeper and having a rotational-motion axis; and a pivotal coupling coupled to the rotational coupling and having a pivotal-motion axis; and wherein:

the base-end of the linear actuator is coupled to the pivotal coupling;

the linear actuator is pivotally movable about the pivotal-motion axis relative to the creeper; and the linear actuator is rotationally movable about the rotational-motion axis relative to the creeper.

14. The apparatus of claim 13, further comprising a biasing device coupled to the pivotal coupling and the linear actuator, wherein the biasing device is configured to bias the linear actuator at a biased angular orientation relative to a horizontal plane.

15. The apparatus of claim 13, further comprising a linear coupling coupled to the creeper and having a linear-motion axis; and wherein:

the rotational coupling is coupled to the linear coupling; and the linear actuator is linearly movable along the linear-motion axis relative to the creeper.

16. The apparatus of claim 15, wherein:

the rotational-motion axis is approximately perpendicular to the linear-motion axis; and the pivotal-motion axis is approximately perpendicular to the rotational-motion axis.

17. A method of making a surface preparation support apparatus, the method comprising:

coupling a base-end of a linear actuator to a creeper;

coupling an actuator-controller to the linear actuator, the actuator-controller being operable to selectively actuate the linear actuator such that a tool-end of the linear actuator moves relative to the base-end of the linear actuator;

coupling a tool-mount to the tool-end of the linear actuator, the tool-mount being configured for attachment of a surface preparation tool; and configuring a tool-controller to be coupled to the surface preparation tool, the tool-controller being operable to selectively energize the surface preparation tool.

18. The method of claim 17, wherein coupling the base-end of the linear actuator to the creeper comprises:

coupling a rotational coupling to the creeper;

coupling a pivotal coupling to the rotational coupling; and coupling the base-end of the linear actuator to the pivotal coupling so that the linear actuator is pivotally movable relative to the creeper about a pivotal-motion axis of the pivot coupling and is rotationally movable relative to the creeper about a rotational-motion axis of the rotational coupling.

19. The method of claim 18, further comprising coupling a biasing device to the pivotal coupling and the linear actuator, wherein the biasing device is configured to bias the linear actuator at a biased angular orientation relative to a horizontal plane.

20. The method of claim 18, wherein coupling the base-end of the linear actuator to the creeper further comprises:

coupling a linear coupling to the creeper; and coupling the rotational coupling to the linear coupling so that the linear actuator is linearly movable relative to the creeper about a linear-motion axis of the linear coupling.

* * * * *